US011393622B2

(12) United States Patent
Muramoto et al.

(10) Patent No.: US 11,393,622 B2
(45) Date of Patent: Jul. 19, 2022

(54) IGNITION APPARATUS

(71) Applicant: Mitsubishi Electric Corporation, Tokyo (JP)

(72) Inventors: Yuichi Muramoto, Tokyo (JP); Kimihiko Tanaya, Tokyo (JP); Naoki Kataoka, Tokyo (JP); Yusuke Naruse, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 206 days.

(21) Appl. No.: 16/914,606

(22) Filed: Jun. 29, 2020

(65) Prior Publication Data

US 2021/0082618 A1 Mar. 18, 2021

(30) Foreign Application Priority Data

Sep. 12, 2019 (JP) ..... JP2019-165847
Feb. 6, 2020 (JP) ..... JP2020-018630

(51) Int. Cl.

| | |
|---|---|
| ***H01F 38/12*** | (2006.01) |
| ***H01F 7/06*** | (2006.01) |
| ***F02P 3/05*** | (2006.01) |
| ***F02P 3/04*** | (2006.01) |
| ***F02P 5/04*** | (2006.01) |

(52) U.S. Cl.

CPC ..... *H01F 38/12* (2013.01); *F02P 3/0414* (2013.01); *F02P 3/053* (2013.01); *F02P 5/04* (2013.01); *H01F 7/064* (2013.01)

(58) Field of Classification Search

CPC ..... H01F 38/12; H01F 7/064; F02P 3/0414; F02P 3/053; F02P 5/04; F02P 3/04; F02P 3/01; F02P 3/05; F02P 9/007; F02P 15/08

See application file for complete search history.

(56) References Cited

U.S. PATENT DOCUMENTS

2007/0175461 A1 8/2007 Wada et al.

FOREIGN PATENT DOCUMENTS

| | | | | |
|---|---|---|---|---|
| JP | 2000-199470 A | 7/2000 | | |
| JP | 2007-231927 A | 9/2007 | | |
| WO | WO-2017060935 A1 * | 4/2017 | ..... | F02P 15/10 |

* cited by examiner

*Primary Examiner* — Jacob M Amick
*Assistant Examiner* — Charles J Brauch
(74) *Attorney, Agent, or Firm* — Richard C. Turner

(57) ABSTRACT

There is provided an ignition apparatus that makes it possible that after a spark discharge starts, a secondary current is reduced so that a plug is suppressed from being consumed. The ignition apparatus is provided with an ignition coil including a primary coil, a secondary coil, and a tertiary coil, a first switching circuit for performing on/off-switching of energization of the primary coil from a power source, a second switching circuit for performing on/off-switching of energization of the tertiary coil, and a controller that performs on/off-control of the first switching circuit so as to generate a secondary current in the secondary coil, thereby causing a spark discharge in an ignition plug, and then turns on the second switching circuit so as to reduce the secondary current through a change in flux in the tertiary coil.

20 Claims, 30 Drawing Sheets

FIG. 28

| item | driving condition | high-primary-voltage-ON control | low-primary-voltage-ON control |
|---|---|---|---|
| filling efficiency | $Ce1 \leqq Ce < Ce2$<br>Ce:filling efficiency | available | N.A. |
| air-fuel ratio | $Kaf1 \leqq Kaf < Kaf2$<br>Kaf:air-fuel ratio coefficient | available | N.A. |
| rotation speed | $Ne1 \leqq Ne < Ne2$<br>Ne:rotation speed | N.A. | available |

IGNITION APPARATUS

BACKGROUND OF THE INVENTION

Field of the Invention

The present disclosure relates to an ignition apparatus.

Description of the Related Art

There exists an ignition coil that is mounted in an internal combustion engine and supplies energy to an ignition plug so that a spark discharge is generated. In particular, there is known an ignition coil that makes a current flow in an ignition coil at the primary side so as to vary energy (current) to be generated at the secondary side. In order to improve the gasoline mileage of an internal combustion engine, there have been being promoted dilution of a fuel-air mixture in which air and fuel are mixed with each other and EGR-rate raising in which the rate of EGR (exhaust gas recirculation) is raised. A fuel-air mixture to which dilution or EGR-rate raising is applied is liable to unstably combust; however, it is known that the flammability is raised by strengthen a rotational flow (fluidity) such as a tumble (vertical eddy current) or a swirl (horizontal eddy current) in a combustion chamber. In order to make a fuel-air mixture having a strong fluidity stably combust, it is required that energy raising or, especially, current enlargement is applied to an ignition apparatus that prevents a spark discharge from being blown out.

As this kind of an internal-combustion-engine ignition apparatus, the one configured in such a way as to perform multiple ignition is known. For example, Patent Document 1 discloses a configuration in which discharges are continually generated two or more times in a single combustion stroke. On the other hand, Patent Document 2 discloses a configuration in which in order to obtain long-discharging-time multiple-discharge characteristics, two ignition coils are connected in parallel with each other.

PRIOR ART REFERENCE

Patent Document

[Patent Document 1] JP2007-231927 A
[Patent Document 2] JP2000-199470 A

In the case where as the configuration disclosed in Patent Document 1, discharges are continually generated two or more times in a single combustion stroke, there exists a problem that because in an interval from the start to the end of an ignition discharge within a certain stroke, the ignition discharge current recurrently becomes zero, no plentiful flammability cannot be secured. On the other hand, in the configuration in which as disclosed in Patent Document 2, two ignition coils are connected in parallel with each other, although in an interval from the start to the end of an ignition discharge within a certain stroke, the ignition discharge current recurrently does not become zero, there exists a problem that the apparatus configuration becomes complicated and hence the apparatus is upsized.

In the case where discharges are continually generated two or more times, the ignition discharge current recurrently becomes zero and hence the discharge is blown out; then, a re-discharge is started. Alternate repetition of blowout and re-discharge may drastically consume the ignition plug. When a secondary current is sufficiently large, no blowout of a discharge is caused; however, when the secondary current is larger than necessary, consumption of the electrodes of the ignition plug is caused; thus, the lifetime of the ignition plug may be shortened.

The objective of the present disclosure is to provide an ignition apparatus that makes it possible that after a spark discharge starts, the secondary current is reduced so that the plug is suppressed from being consumed.

SUMMARY OF THE INVENTION

An ignition apparatus according to the present disclosure is provided with an ignition coil including a primary coil, a secondary coil that is magnetically coupled with the primary coil and supplies a secondary current to an ignition plug, and a tertiary coil that is magnetically coupled with the primary coil and the secondary coil and generates energization flux for reducing the secondary current, a first switching circuit for performing on/off-switching of energization of the primary coil from a power source, a second switching circuit for performing on/off-switching of energization of the tertiary coil, and a controller that performs on/off-control of the first switching circuit so as to generate a secondary current in the secondary coil through a change in flux generated in the primary coil, thereby causing a spark discharge in an ignition plug, and then turns on the second switching circuit after the secondary current has been generated, thereby reducing the secondary current through a change in flux in the tertiary coil.

In an ignition apparatus according to the present disclosure, after the secondary current has been generated, the second switching circuit is turned on so as to make a current flow in the tertiary coil, so that energization flux for decreasing the secondary current can be generated in the tertiary coil. Accordingly, consumption of the plug can be suppressed by suppressing the current flowing in the secondary coil.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 28 is a figure representing switching of control in accordance with an operation state in the ignition apparatus according to Embodiment 14;

DETAILED DESCRIPTION OF THE PREFERRED EMBODIMENTS

Hereinafter, embodiments of an ignition apparatus according to the present disclosure will be explained with reference to the drawings.

1. Embodiment 1

Figure 1:
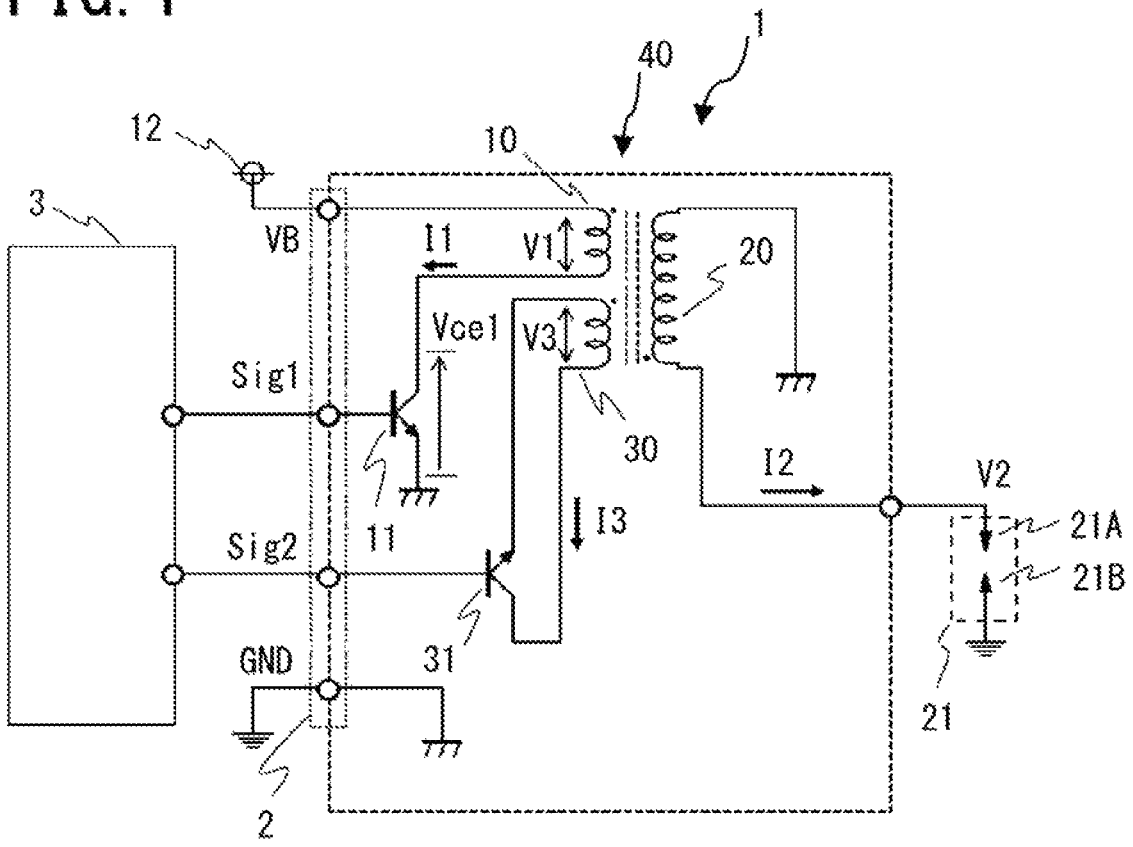
FIG. 1 is a circuit diagram of an ignition apparatus according to Embodiment 1.

FIG. 1 is a circuit diagram of an ignition apparatus according to Embodiment 1. As represented in FIG. 1, an ignition apparatus 1 is provided with an ignition coil 40 including a primary coil 10, a secondary coil 20, and a tertiary coil 30, an ignition plug 21, a first switching circuit 11, a second switching circuit 31, an ignition-coil power source 12, a controller 3, and the like.

1-1. Basic Configuration of Ignition Apparatus

The ignition plug 21 has a first electrode 21A and a second electrode 21B that face each other via a gap and ignites an inflammable fuel-air mixture in a combustion chamber. The first electrode 21A and the second electrode 21B of the ignition plug 21 are arranged in a combustion chamber (in a cylinder). The first electrode 21A is connected with the secondary coil 20, and the second electrode 21B is connected with the ground.

The ignition coil 40 has the primary coil 10 that generates energization flux, when energized, the secondary coil 20 that is magnetically coupled with the primary coil 10, that generates a secondary current based on a change in the flux in the primary coil, and that supplies discharge energy to the ignition plug 21 so as to cause a spark discharge, and the tertiary coil 30 that is magnetically coupled with the primary coil 10 and the secondary coil 20 and that generates energization flux for reducing the secondary current in the secondary coil 20, when energized. The primary coil 10, the secondary coil 20, and the tertiary coil 30 are wound on a common iron core. The number of turns of the secondary coil 20 is larger than that of the primary coil 10.

One end of the primary coil 10 is connected with the DC ignition-coil power source 12 by way of an ignition coil input connector 2; the other end of the primary coil 10 is connected with the ground by way of the first switching circuit 11. The both ends of the tertiary coil 30 are connected with each other by way of the second switching circuit 31. That is to say, the tertiary coil 30 and the second switching circuit 31 are connected in series with each other in a looped electric wire. The ground in the ignition coil 40 is earthed by way of the ignition coil input connector 2. The ground in the ignition coil 40 may be connected with the negative terminal of a battery.

The respective coils are wound in such a way that the direction of the flux generated at a time when the first switching circuit 11 is turned on so as to energize the primary coil 10 and the direction of the flux generated at a time when the second switching circuit 31 is turned on so as to energize the tertiary coil 30 are the same.

The first switching circuit 11 is a switching circuit for performing on/off-switching of the energization of the primary coil 10 from the DC ignition-coil power source 12. A driving signal Sig1 outputted from the controller 3 is inputted to the first switching circuit 11, so that the driving signal Sig1 performs on/off-switching of the first switching circuit 11.

The second switching circuit 31 is a switching circuit for performing on/off-switching of the energization of the tertiary coil 30. A driving signal Sig2 outputted from the controller 3 is inputted to the second switching circuit 31, so that the driving signal Sig2 performs on/off-switching of the second switching circuit 31.

FIG. 1 represents a circuit in which as each of the first switching circuit 11 and the second switching circuit 31, an NPN-type transistor is utilized; however, a PNP-type transistor, an IGBT (Insulated Gate Bipolar Transistor), a MOSFET (Metal Oxide Semiconductor Field Effect Transistor), or the like may be utilized.

1-2: Controller

Figure 2:
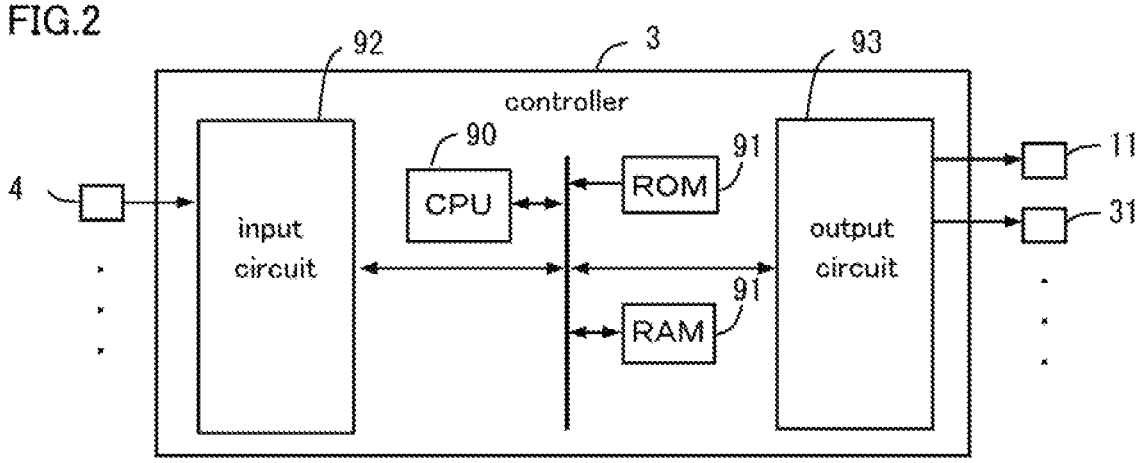
FIG. 2 is a hardware configuration diagram of a controller according to Embodiment 1.

In the present embodiment, the controller 3 is a controller for controlling an internal combustion engine. Functions of the controller 3 are realized by processing circuits provided in the controller 3. Specifically, as illustrated in FIG. 2, the controller 3 includes, as the processing circuits, a computing processing unit (computer) 90 such as a CPU (Central Processing Unit), storage apparatuses 91 that exchange data with the computing processing unit 90, an input circuit 92 that inputs external signals to the computing processing unit 90, an output circuit 93 that outputs signals from the computing processing unit 90 to the outside, and the like.

As the computing processing unit 90, there may be provided any one of an ASIC (Application Specific Integrated Circuit), an IC (Integrated Circuit), a DSP (Digital Signal Processor), an FPGA (Field Programmable Gate Array), various kinds of logic circuits, various kinds of signal processing circuits, and the like. In addition, it may be allowed that as the computing processing unit 90, two or more computing processing units of the same type or different types are provided and respective processing items are implemented in a sharing manner. As the storage apparatuses 91, there are provided a RAM (Random Access Memory) that can read data from and write data in the computing processing unit 90, a ROM (Read Only Memory) that can read data from the computing processing unit 90, and the like. A voltage detection input 4, a switch, and various kinds of sensors such as a crank angle sensor, a cam angle sensor, an intake quantity detection sensor, a water temperature sensor, and a power-source voltage sensor are connected with the input circuit 92; the input circuit 92 is provided with an A/D converter and the like that input the output signals of these sensors and switches to the computing processing unit 90. The output circuit 93 is connected with electric loads such as the first switching circuit 11, the second switching circuit 31, and an injector and is provided with a driving circuit and the like for outputting a control signal from the computing processing unit 90 to these electric loads.

The computing processing unit 90 runs software items (programs) stored in the storage apparatuses 91 such as a ROM and the like and collaborates with other hardware devices in the controller 3, such as the storage apparatuses 91, the input circuit 92, and the output circuit 93, so that the respective functions of the controller 3 are realized. Setting data items such as a threshold value and a determination value to be utilized in the controller 3 are stored, as part of software items (programs), in the storage apparatuses 91 such as a ROM and the like.

As basic control, the controller 3 calculates the rotation speed of the internal combustion engine, the efficiency of filling a fuel-air mixture into a cylinder, the fuel injection amount, the ignition timing, and the like based on inputted output signals and the like from the various kinds of sensors, and then performs driving control of the injector, the first switching circuit 11, the second switching circuit 31, and the like.

<Ignition Control>

After turning on the first switching circuit 11 so as to turning on energization of the primary coil 10, the controller 3 turns off the first switching circuit 11 so as to turn off the energization of the primary coil 10 and to produce a spark discharge in the ignition plug 21.

The controller 3 calculates an energization period for the primary coil 10 and an ignition timing (ignition crank angle). After turning on the first switching circuit 11 so as to energize the primary coil 10 during the energization period, the controller 3 turns off the first switching circuit 11 at the ignition timing so as to cut off the energization of the primary coil 10, to cause the secondary coil 20 generate a high voltage, and to produce a spark discharge in the ignition plug 21. The spark discharge lasts until magnetic energy accumulated in the iron core of the ignition plug 21 decreases. In the present embodiment, the explanation has been made with a flyback method in which a primary current is cut off so as to generate a high voltage in the secondary coil; however, a forward method in which primary-current energization generates a high voltage in the secondary coil also makes it possible that on-operation of the first switching circuit 11 generates a secondary current in the secondary coil.

<Tertiary Coil Energization Control>

When during a spark discharge, the tertiary coil 30 is energized, a current flows in the direction for reducing the secondary current in the secondary coil. An operation-waveform group 1 of the ignition apparatus will be explained by use of FIG. 3.

Figure 3:
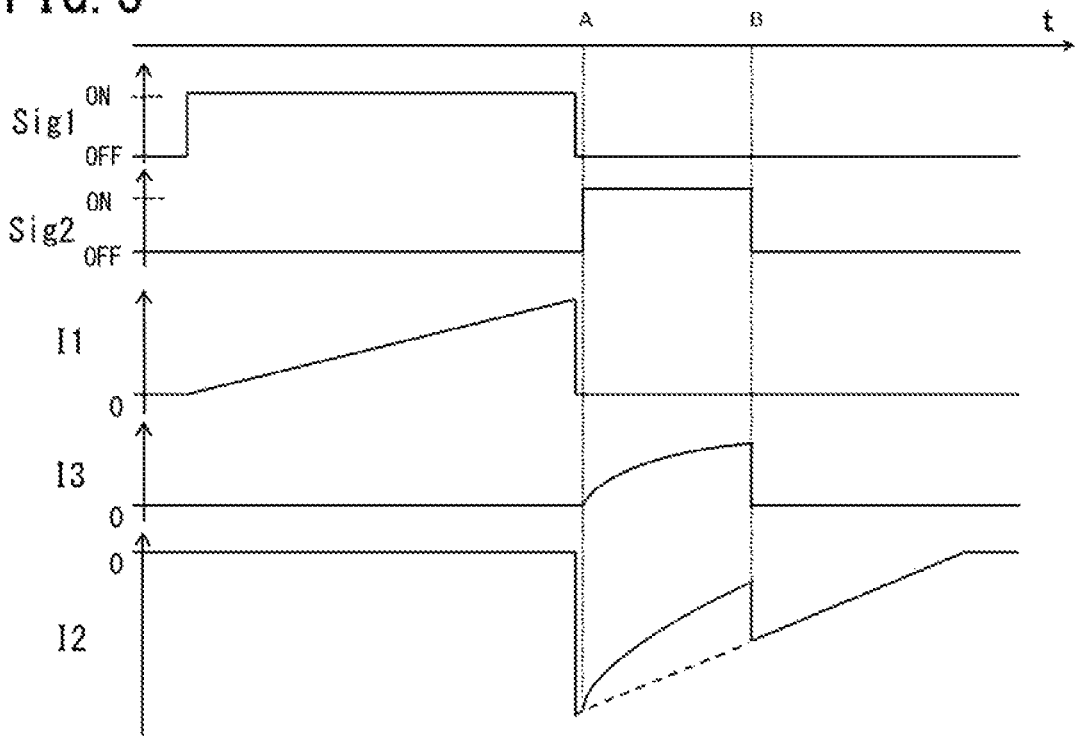
FIG. 3 is a chart representing an operation-waveform group 1 of the ignition apparatus according to Embodiment 1.

FIG. 3 is a chart representing an operation-waveform group 1 of the ignition apparatus according to Embodiment 1. FIG. 3 is a timing chart and represents, from top to bottom, the respective waveforms of the driving signal Sig1 for the first switching circuit 11, the driving signal Sig2 for the second switching circuit 31, a primary current I1 flowing in the primary coil 10, a tertiary current I3 flowing in the tertiary coil 30, and a secondary current I2 flowing in the secondary coil 20.

The controller 3 supplies the driving signal Sig1 to the first switching circuit 11 so as to turn on or off the first switching circuit 11, so that the energization current in the primary coil 10 is made to flow or cut off. When the primary current I1 is cut off, a negative large voltage is generated across the secondary coil 20, due to a mutual inductive action. This voltage causes a dielectric breakdown between the gaps of the ignition plug 21 and a discharge is produced. In this situation, a negative secondary current I2 flows in the secondary coil 20. The positive direction of the secondary current I2 is indicated by an arrow in FIG. 1.

The controller 3 turns off the first switching circuit 11 and then turns on the second switching circuit 31 after the secondary current has been generated. After the secondary current has been generated, the second switching circuit 31 is turned on so as to make a current flow in the tertiary coil, so that energization flux for decreasing the secondary current can be generated in the tertiary coil. Accordingly, consumption of the plug can be suppressed by suppressing the current flowing in the secondary coil.

In the example in FIG. 3, the controller 3 once performs off-after-on control in which after the secondary current has been generated, the second switching circuit 31 is turned on and then turned off. The controller 3 turns on the second switching circuit 31 immediately after the secondary current is generated (at a time point A), and then turns off the second switching circuit 31 after an on-period of the second switching circuit 31 elapses (at a time point B). The on-period of the second switching circuit 31 is set in such a way that the magnitude of the secondary current I2 does not decrease more than necessary (for example, the magnitude of the secondary current I2 does not become smaller than a lower limit value). For example, the controller 3 determines the on-period of the second switching circuit 31, based on the operation state (e.g., the rotation speed, the filling efficiency, or the like) of the internal combustion engine. The magnitude of the secondary current becomes largest immediately after the secondary current is generated, and then decreases. Therefore, the period in which the secondary current I2 increases can be shortened by turning on the second switching circuit 31 during the on-period immediately after the secondary current is generated.

In order to turn on the second switching circuit 31, the controller 3 makes the driving signal Sig2 for the second switching circuit 31 become a high-level signal (ON output). As a result, the both ends of the tertiary coil are electrically connected with each other (short-circuited). Accordingly, the tertiary coil receives part of the discharging energy so that the tertiary current I3 flows in the tertiary coil 30. The positive direction of the tertiary current I3 is indicated by an arrow in FIG. 1. Accordingly, a current (the tertiary current I3×the number of turns of the tertiary coil/the number of turns of the secondary coil) corresponding to the turn ratio of the tertiary coil 30 to the secondary coil 20 is subtracted from the secondary current I2. After that, when the second switching circuit 31 is turned off at the time point B, the tertiary current I3 is cut off and hence the reduction amount of the secondary current I2 becomes "0".

Even when the fluidity of a fuel-air mixture in the cylinder of the internal combustion engine is large, the ignitability of a discharge is raised by supplying high ignition energy. A stable combustion state can be continued by securing a sufficient discharge continuance time after ignition; however, while the discharge continues, a sufficient ignitability can be obtained even when the discharge current is small. In this case, reduction of the secondary current I2 makes it possible to obtain an effect that the consumption energy is suppressed from increasing and hence consumption of the ignition plug 21 is suppressed.

Moreover, in the configuration according to Embodiment 1, the tertiary coil 30 is not connected with the ignition-coil power source 12, and the current that flows therein is determined in accordance with the turn ratio of the number of turns of the tertiary coil 30 to the number of turns of the secondary coil 20; therefore, there exists an advantage that the magnitude of the tertiary current I3 is insusceptible to a change in the power-source voltage.

In the present embodiment, the explanation has been made with a flyback method in which a primary current is cut off so as to make the secondary coil generate a high voltage; however, a forward method in which primary-current energization makes the secondary coil generate a high voltage also makes it possible to reduce the secondary current by turning on the second switching circuit 31 after the secondary current is generated.

Figure 4:
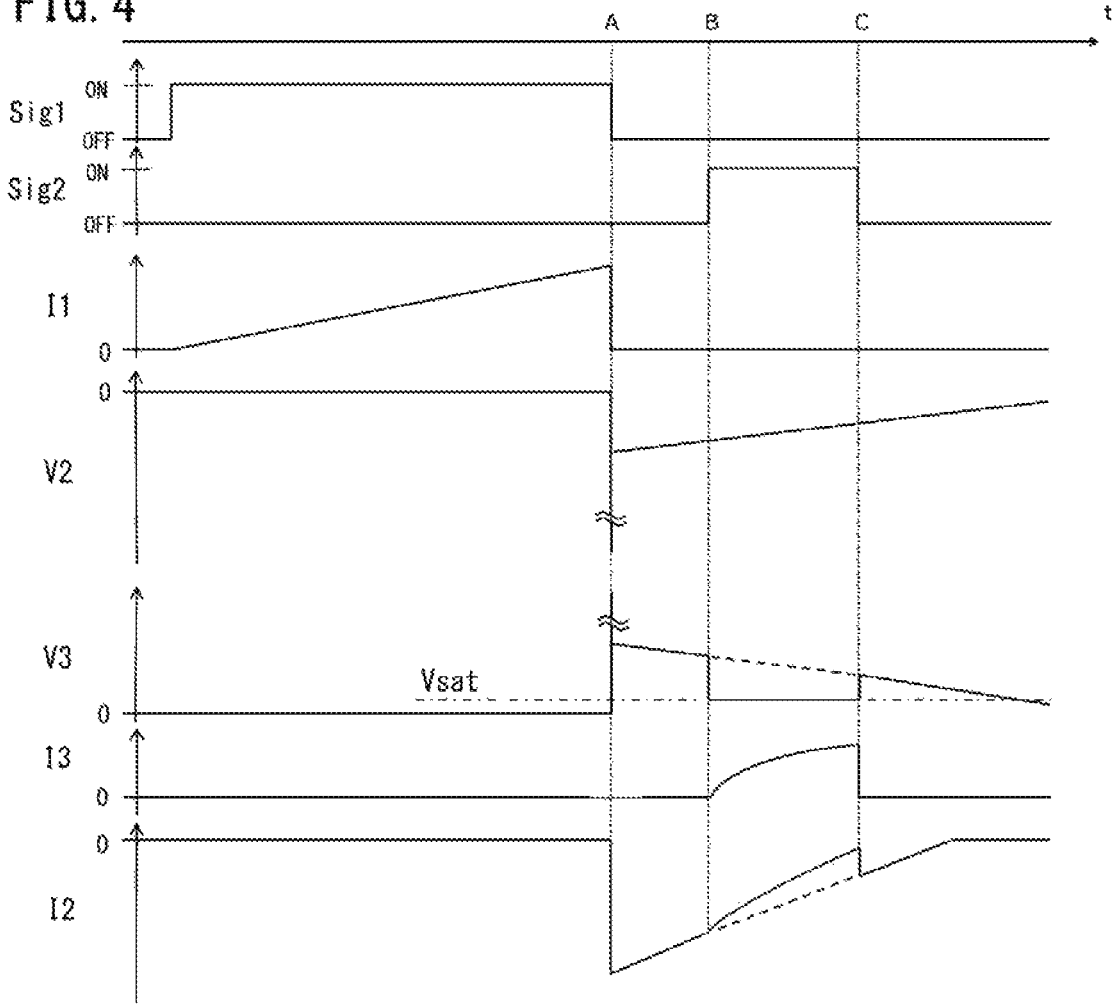
FIG. 4 is a chart representing an operation-waveform group 2 of the ignition apparatus according to Embodiment 1.

FIG. 4 is a chart representing an operation-waveform group 2 of the ignition apparatus according to Embodiment 1. FIG. 4 is a timing chart and represents, from top to bottom, the respective waveforms of the driving signal Sig1 for the first switching circuit 11, the driving signal Sig2 for the second switching circuit 31, the primary current I1 flowing in the primary coil 10, an inter-GAP voltage V2 of the ignition plug 21, a tertiary coil inter-terminal voltage V3 across the both terminals of the tertiary coil 30, the tertiary current I3 flowing in the tertiary coil 30, and the secondary current I2 flowing in the secondary coil 20.

The operation till the dielectric breakdown at the time point A is the same as the operation represented by the operation-waveform group 1 in FIG. 3; thus, the explanation therefor will be omitted here. In FIG. 4, the controller 3 turns on the second switching circuit 31 after the secondary current is generated at the time point A and then a delay period elapses, and then turns off the second switching circuit 31 at a time point C after the on-period of the second switching circuit 31 elapses. As this example shows, it may be allowed that at a time immediately after the secondary current is generated, the second switching circuit is not turned on but the secondary current I2 of a large magnitude is maintained so that the ignitability of the fuel-air mixture is raised. Thus, depending on the necessity of the ignitability, there can be selected the case where as represented in FIG. 3, the delay period is set to be short or the case where as represented in FIG. 4, the delay period is set to be long. Based on the operation state (e.g., the rotation speed, the filling efficiency, or the like) of the internal combustion engine, the controller 3 determines the delay period from a time when the first switching circuit 11 is turned off to a time when the second switching circuit 31 is turned on.

As is the case with the period from the time point A to a time point when a dielectric breakdown occurs, for the inter-GAP voltage V2 of the ignition plug 21, the tertiary coil inter-terminal voltage V3 corresponding to the turn ratio of the number of turns of the tertiary coil to the number of turns of the secondary coil is generated across the both ends of the tertiary coil 30 and is applied between the collector and the emitter of the second switching circuit 31. In this situation, when the tertiary coil inter-terminal voltage V3 is smaller than the on-time saturation voltage Vsat between the collector and the emitter of the second switching circuit 31, the tertiary current I3 cannot be made to flow while the driving signal Sig2 is inputted to the second switching circuit 31 during the period from the time point B to the time point C. Therefore, it is required to set the turn ratio of the number of turns of the tertiary coil to the number of turns of the secondary coil in such a way that the tertiary coil inter-terminal voltage V3 becomes the same as or larger than the on-time saturation voltage Vsat.

For example, in the case where the inter-GAP voltage V2 is 800 V, the number of turns of the secondary coil is 8000 T, and the Vsat is 2 V, it needs to be established that the number of turns of the tertiary coil/8000 T×800 V≥2 V; thus, it needs to be established that the number of turns of the tertiary coil≥20 T.

Because in the period between the time point B and the time point C, the second switching circuit 31 is turned on, the tertiary current I3 flows under the condition that the tertiary coil inter-terminal voltage V3 coincides with the on-time saturation voltage Vsat. In the period in which the secondary current I2 is generated, excluding the period between the time point B and the time point C, the tertiary coil inter-terminal voltage V3 is larger than the on-time saturation voltage Vsat.

As described above, the number of turns of the tertiary coil 30 is set in consideration of the number of turns of the secondary coil 20. Because a turn ratio within the appropriate range is maintained, the second switching circuit 31 can securely be turned on or off; thus, the secondary current can be decreased by energizing the tertiary coil.

2. Embodiment 2

Figure 5:
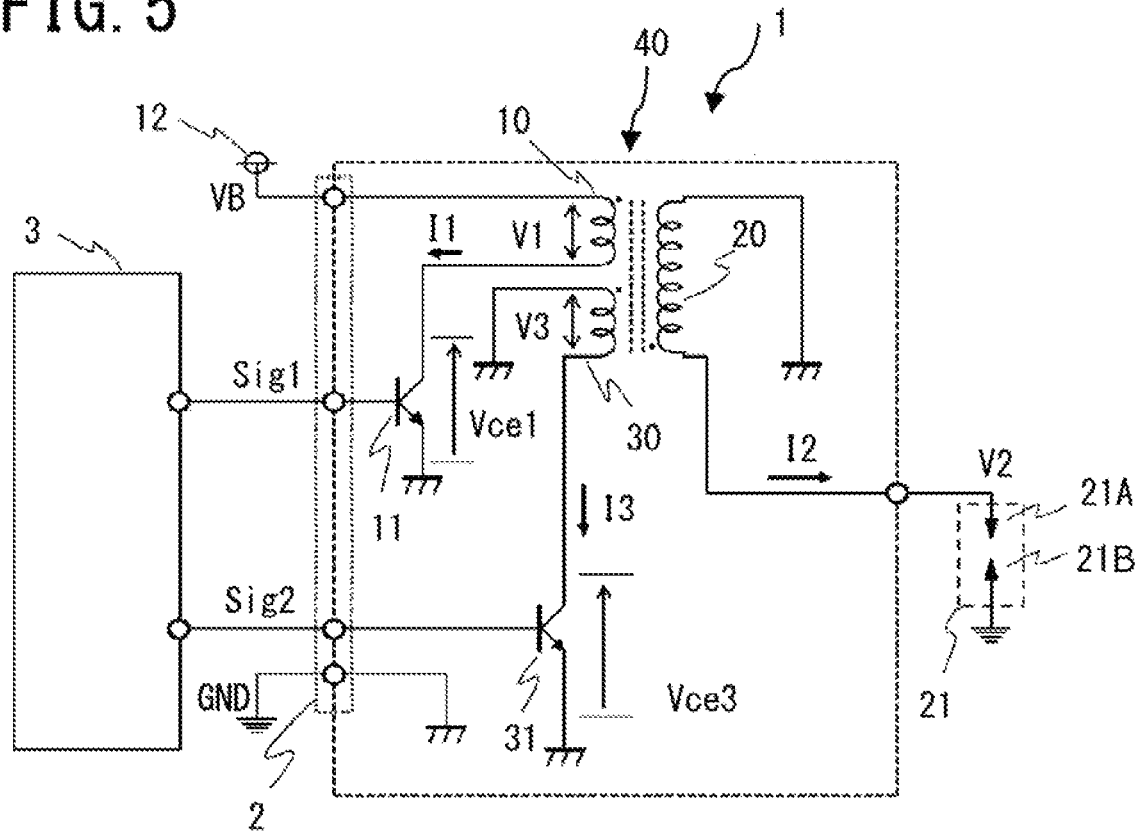
FIG. 5 is a circuit diagram of an ignition apparatus according to Embodiment 2.

FIG. 5 is a circuit diagram of an ignition apparatus according to Embodiment 2. The configuration in FIG. 5 is different from that of Embodiment 1 represented in FIG. 1 in that the collector of the second switching circuit 31 illustrated as an NPN-type transistor is connected with the high-voltage side of the tertiary coil 30, the emitter thereof is connected with GND, and the low-voltage side of the tertiary coil 30 is connected with GND. That is to say, the tertiary coil 30 and the second switching circuit 31 are connected in series with each other in an electric wire whose both ends are connected with the ground. By way of GND, the both ends of the tertiary coil can be connected with (short-circuited) or disconnected from each other by turning on or off the second switching circuit 31.

Embodiment 2 makes it possible that there is performed a function the same as that of Embodiment 1, i.e., the secondary current I2 is decreased by energization of the tertiary current I3, and that there is obtained an effect the same as that of Embodiment 1, i.e., the secondary current I2 is decreased so that the consumption energy is suppressed from increasing and hence the consumption of the ignition plug 21 is suppressed. The configuration of Embodiment 2 represented in FIG. 5 makes it possible that in comparison with the configuration of Embodiment 1 represented in FIG. 1, the second switching circuit 31 is driven on the GND level; thus, inexpensive devices can be utilized.

In FIG. 5, there has been explained the example in which by way of GND, the both ends of the tertiary coil are connected with (short-circuited) or disconnected from each other; however, by way of the ignition-coil power source 12, the both ends of the tertiary coil can be connected with (short-circuited) or disconnected from each other. In that case, the collector of the second switching circuit 31 illustrated as an NPN-type transistor in FIG. 5 is connected with the high-voltage side of the tertiary coil 30, the emitter thereof is connected with the ignition-coil power source 12, and the low-voltage side of the tertiary coil 30 is connected with the ignition-coil power source 12. In addition, the second switching circuit 31 may be replaced by a PNP-type transistor.

3. Embodiment 3

Figure 6:
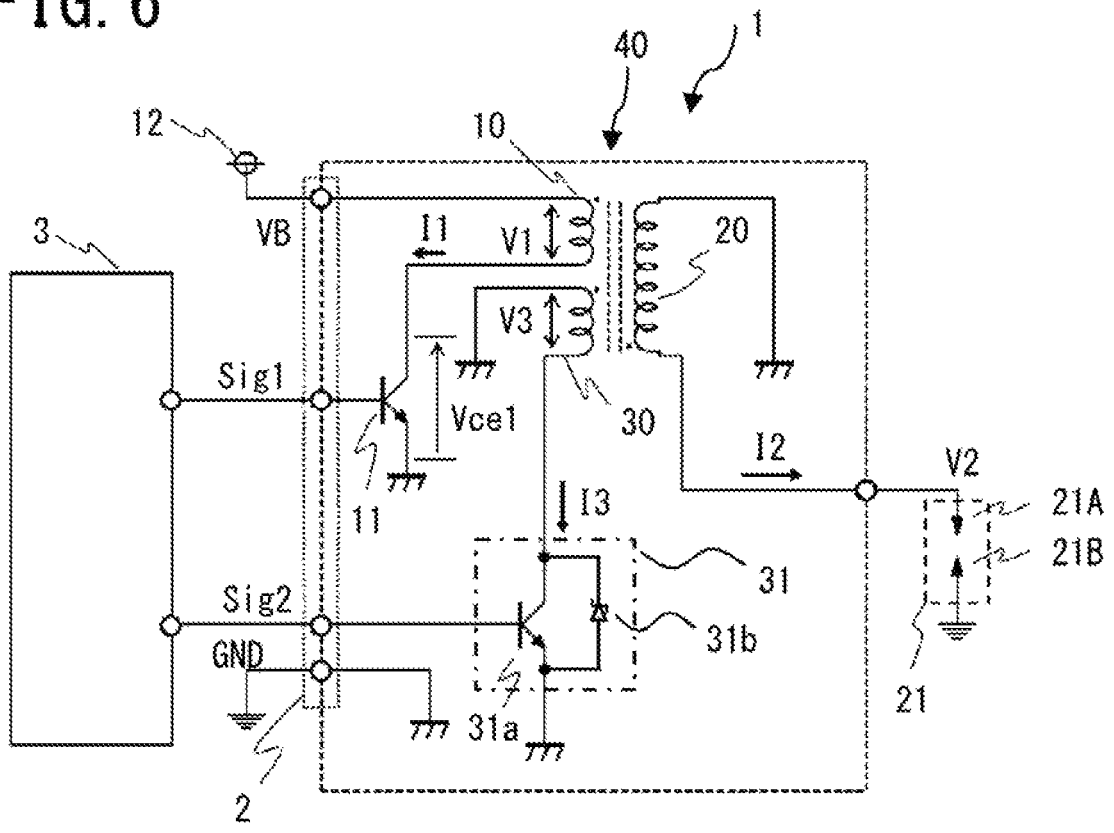
FIG. 6 is a circuit diagram of an ignition apparatus according to Embodiment 3.

FIG. 6 is a circuit diagram of an ignition apparatus according to Embodiment 3. The internal-combustion-engine ignition apparatus according to Embodiment 3 is different from the configuration according to Embodiment 2 in FIG. 5 in that the second switching circuit 31 includes a transistor 31*a* and a Zener diode 31*b*. The Zener diode 31*b* provided between the collector and the emitter of the transistor 31*a* is a voltage protection circuit and limits the voltage to be applied therebetween. Accordingly, it can be prevented that when an excessive voltage is applied to the second switching circuit 31, the performance is deteriorated.

Figure 7:
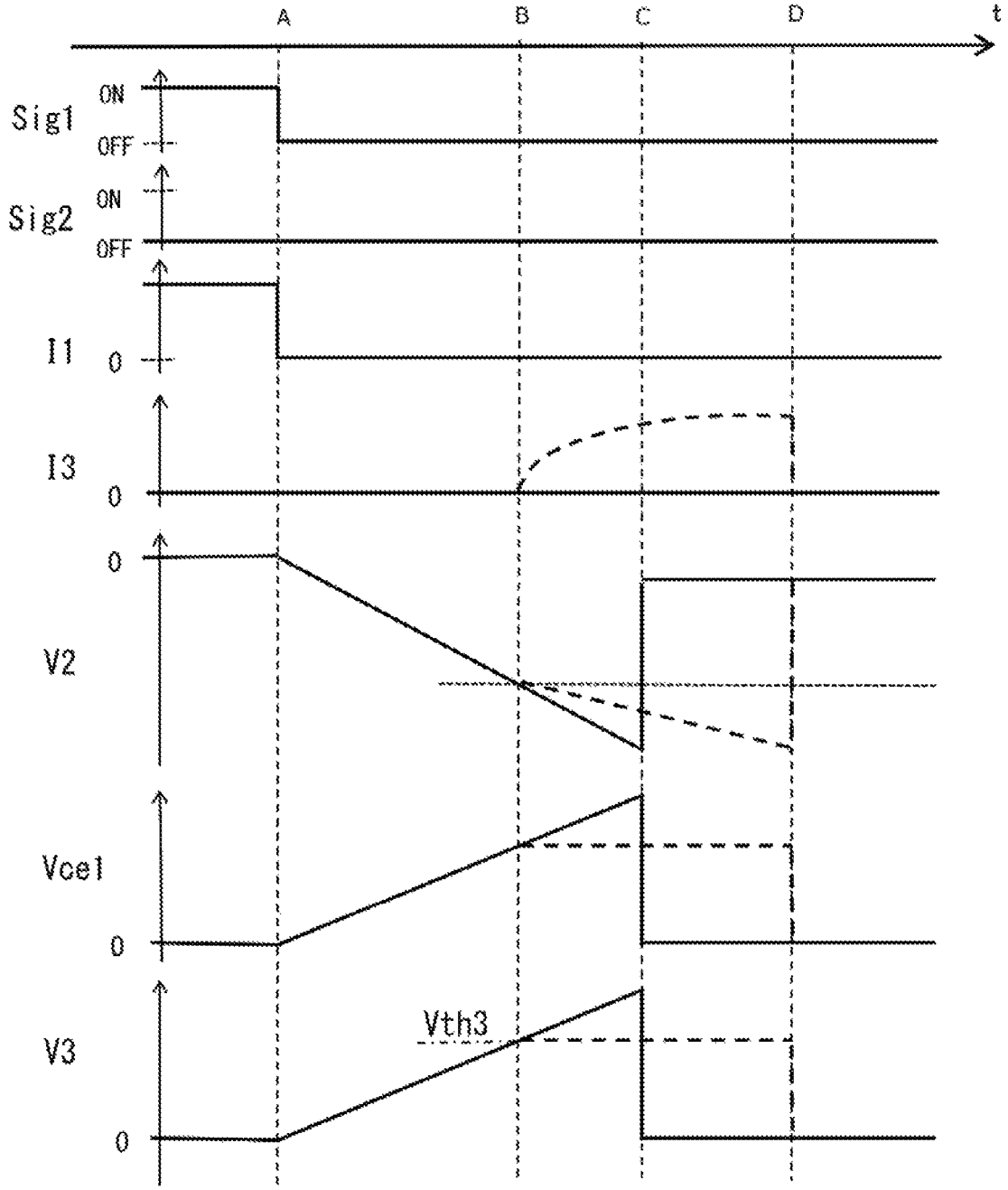
FIG. 7 is a chart representing a group of operation waveforms of the ignition apparatus according to Embodiment 3.

FIG. 7 is a timing chart representing a group of operation waveforms of the ignition apparatus according to Embodiment 3. In FIG. 7, for the sake of making a detailed explanation for the behavior at a time of a dielectric breakdown, the time axis immediately after the first switching circuit 11 is turned off is expanded in comparison with the timing chart in each of FIGS. 3 and 4. FIG. 7 represents, from top to bottom, the respective waveforms of the driving signal Sig1 for the first switching circuit 11, the driving signal Sig2 for the second switching circuit 31, the primary current I1 flowing in the primary coil 10, the tertiary current I3 flowing in the tertiary coil 30, the inter-GAP voltage V2 of the ignition plug 21 till a dielectric breakdown, an inter-terminal voltage Vce1 of the first switching circuit 11, and the inter-terminal voltage V3 of the second switching circuit 31.

The broken lines in FIG. 7 represent the behavior of a comparative example in which unlike the present embodiment, a limit voltage Vth3 determined by the Zener diode 31*b* provided in the second switching circuit 31 is set to be lower than the inter-terminal voltage, of the second switching circuit 31, caused by a dielectric breakdown voltage. In the comparative example, when at the time point B, the inter-terminal voltage of the second switching circuit 31, i.e., the tertiary coil inter-terminal voltage V3 reaches the limit voltage Vth3 determined by the second switching circuit, the tertiary current I3 flows due to the voltage-clamp Zener diode 31*b* of the second switching circuit 31 and hence the energy in the ignition coil is consumed. Accordingly, the time point when a dielectric breakdown occurs is delayed from the time point C to a time point D. Moreover, because the consumption energy in the ignition coil till the occurrence of the dielectric breakdown increases, the output of the ignition coil decreases.

In contrast, in the present embodiment, due to the dielectric breakdown voltage of the ignition plug, the limit voltage Vth3 is set to be higher than the inter-terminal voltage of the second switching circuit through the intermediary of the tertiary coil. Accordingly, as represented by a solid line in FIG. 7, after the timing when at the time point A, the current in the primary coil 10 is cut off, a voltage is generated in the GAP of the ignition plug; then, at the time point C, a dielectric breakdown occurs. For the generated inter-GAP voltage V2 of the ignition plug 21, the tertiary coil inter-terminal voltage V3 corresponding to the turn ratio of the number of turns of the tertiary coil to the number of turns of the secondary coil is generated across the both terminals of the tertiary coil and is applied between the collector and the emitter of the second switching circuit 31. The tertiary coil inter-terminal voltage V3 is applied therebetween, as a collector-emitter voltage Vce3 of the second switching circuit in FIG. 6. In this situation, because the limit voltage Vth3 is the same as or higher than the collector-emitter voltage Vce3, the collector-emitter voltage Vce3 is not limited by the limit voltage Vth3.

Accordingly, appropriate setting of the limit voltage Vth3 according to Embodiment 3 makes it possible that not only the protection of the second switching circuit 31 but also securing of the ignition property can be achieved.

4. Embodiment 4

Figure 8:
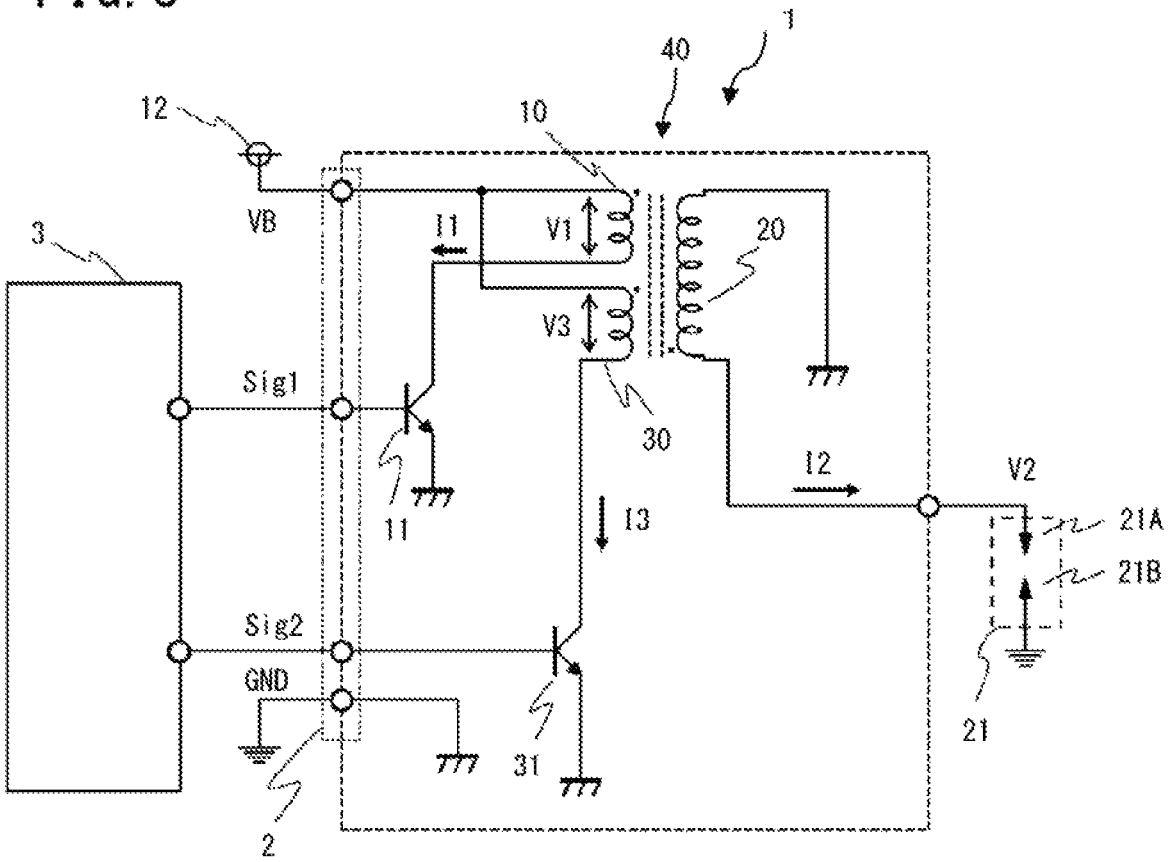
FIG. 8 is a circuit diagram of an ignition apparatus according to Embodiment 4.

FIG. 8 is a circuit diagram of an ignition apparatus according to Embodiment 4. The internal-combustion-engine ignition apparatus according to Embodiment 4 is different from the configuration according to Embodiment 2 in FIG. 5 in that the low-voltage side of the tertiary coil 30 is connected with the ignition-coil power source 12. That is to say, the tertiary coil 30 and the second switching circuit 31 are connected in series with each other in an electric wire, one end of which is connected with the ignition-coil power source 12 and the other end of which is connected with the ground. As a result, when the second switching circuit 31 is turned on, the tertiary coil 30 receives energy from the ignition-coil power source 12 and decreases the secondary current during an energization period; when the second switching circuit 31 is turned off, the tertiary current is cut off and hence magnetic flux is generated; thus, the secondary current is increased and the energization period of the secondary current can be prolonged.

Figure 9:
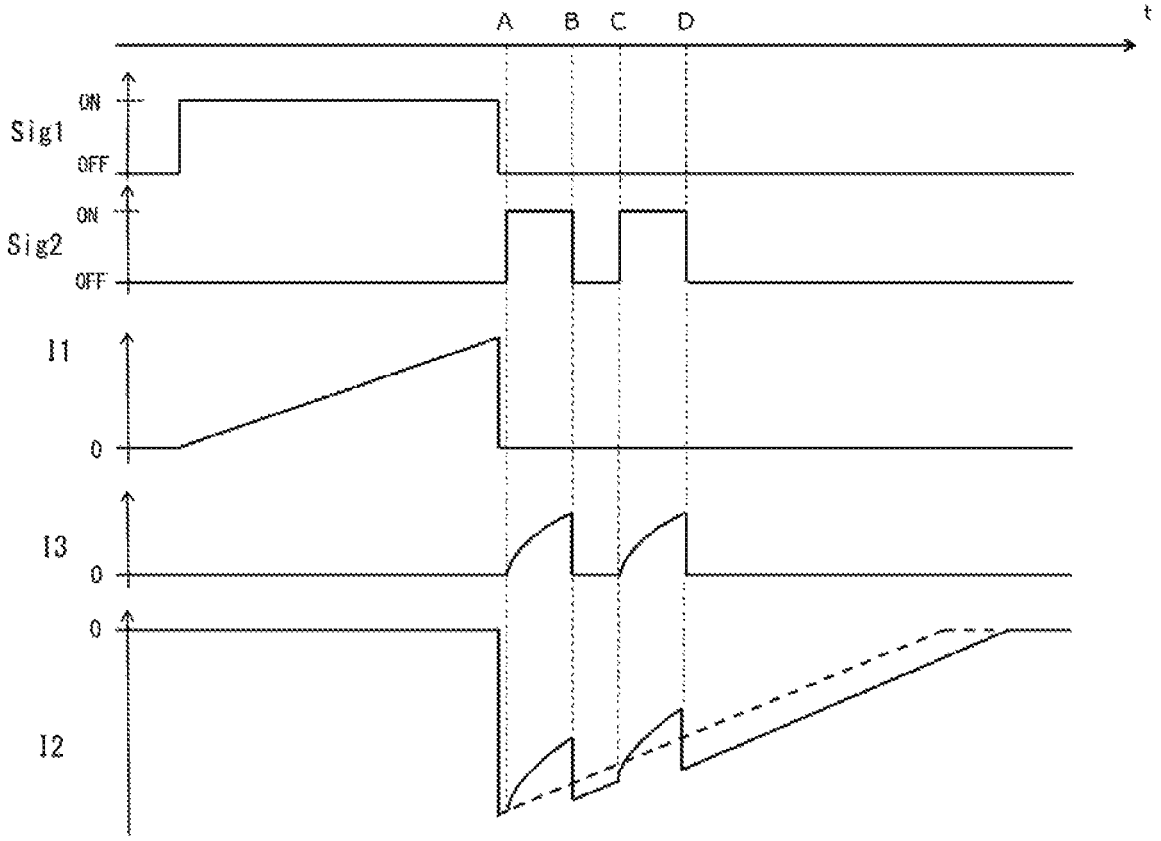
FIG. 9 is a chart representing a group of operation waveforms of the ignition apparatus according to Embodiment 4.

FIG. 9 is a chart representing a group of operation waveforms of the ignition apparatus according to Embodiment 4. FIG. 9 is a timing chart and represents, from top to bottom, the respective waveforms of the driving signal Sig1 for the first switching circuit 11, the driving signal Sig2 for the second switching circuit 31, the primary current I1 flowing in the primary coil 10, the tertiary current I3 flowing in the tertiary coil 30, and the secondary current I2 flowing in the secondary coil 20.

Because the operation till the time when the secondary current I2 is generated is the same as that of each of Embodiments 1 and 2, the explanation therefor will be omitted. The controller performs off-after-on control in which after the secondary current I2 has been generated, the second switching circuit 31 is turned on and then turned off. As a result, it is made possible that after during the on-period of the second switching circuit 31, the secondary current I2 is decreased, the magnetic energy accumulated from the ignition-coil power source 12 into the tertiary coil 30 during the on-period of the second switching circuit 31 increases the secondary current I2 after the second switching circuit 31 is turned off. The controller 3 performs the off-after-on control twice after the secondary current I2 is generated. Based on the operation state (e.g., the rotation speed, the filling efficiency, or the like) of the internal combustion engine, the controller 3 determines the on-timing and the off-timing of each of the off-after-on control actions after the first switching circuit 11 is turned off.

At the time point A, the controller 3 supplies the driving signal Sig2 to the first switching circuit 31 so as to turn on the second switching circuit 31, so that a current from the ignition-coil power source 12 is applied to the tertiary coil 30. As a result, there is generated flux having the direction along which the discharging energy is cancelled and hence the secondary current I2 decreases. As is the case with each of Embodiments 1 and 2, the secondary current I2 decreases by the amount of a current corresponding to multiplying the tertiary current I3 by the turn ratio of the tertiary coil 30 to the secondary coil 20 (the tertiary current I3×the number of turns of the tertiary coil/the number of turns of the secondary coil).

After that, when the second switching circuit 31 is turned off at the time point B, the tertiary current I3 is cut off and hence the decrease in the secondary current I2 ends; magnetic flux generated through the cutoff of the tertiary current I3 increases the secondary current I2. In other words, turning on/off of the second switching circuit 31 makes it possible to obtain an effect that the secondary current I2 is decreased and the discharging time is prolonged.

As a result, Embodiment 4 makes it possible that even in the case where the fluidity of a fuel-air mixture in the cylinder of the internal combustion engine is large, supply of high ignition energy raises the ignitability of a discharge and that decreasing the secondary current I2 suppresses the consumption energy from increasing so that there is obtained an effect that the consumption of the ignition plug 21 is suppressed and the discharging time is prolonged.

In FIG. 9, an On-signal portion of the driving signal Sig2 are generated twice. The driving signal Sig2 is inputted thereto in such a way as to be divided into two or more portions so that the input timing and the On time thereof are optimized; thus, it is made possible to obtain a desirable secondary-current decrease pattern for maintaining stable combustion while suppressing the consumption of the ignition plug 21.

5. Embodiment 5

Figure 10:
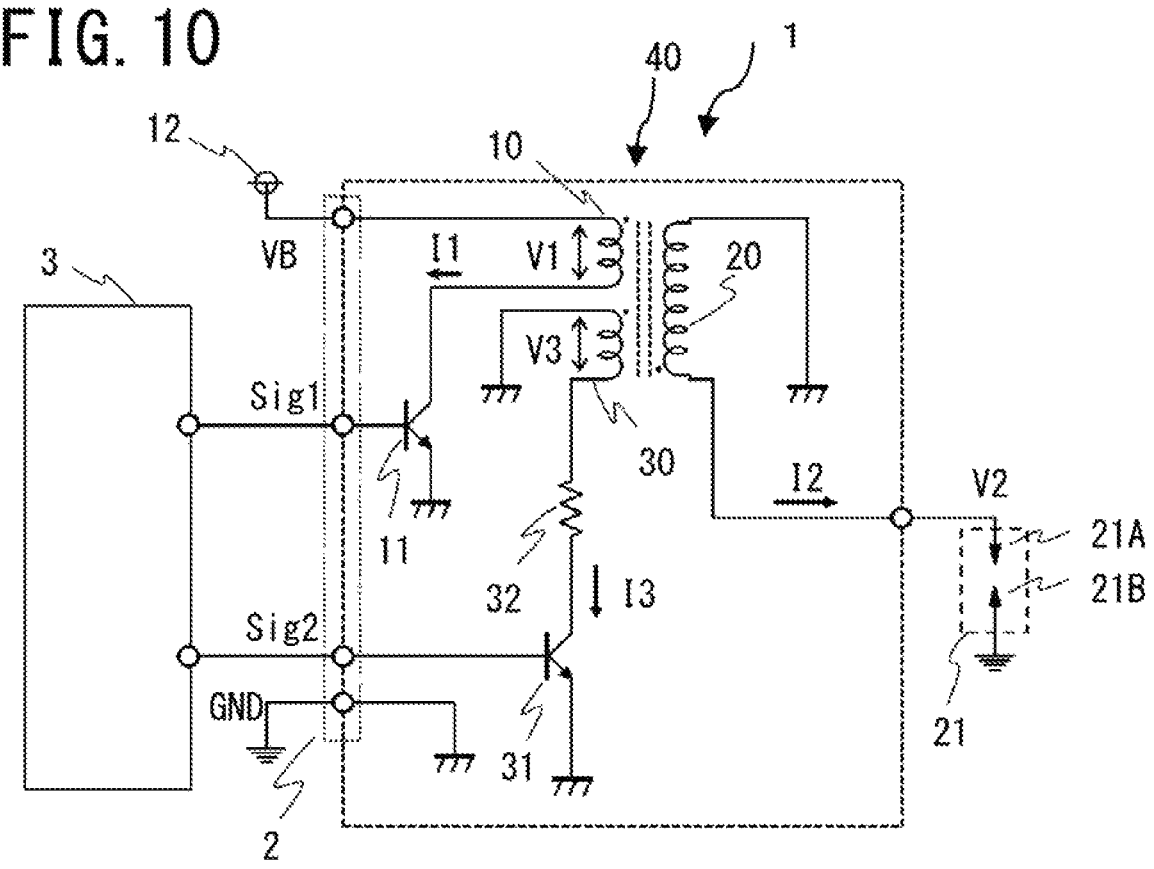
FIG. 10 is a circuit diagram of an ignition apparatus according to Embodiment 5.

FIG. 10 is a circuit diagram of an ignition apparatus according to Embodiment 5. The internal-combustion-engine ignition apparatus according to Embodiment 5 is different from the configuration according to Embodiment 2 in FIG. 5 in that a tertiary current limiting resistor 32 is provided between the high-voltage side of the tertiary coil 30 and the collector of the second switching circuit 31. The tertiary current limiting resistor 32 forms a current limiting circuit for suppressing a current flowing in the tertiary coil.

Figure 11:
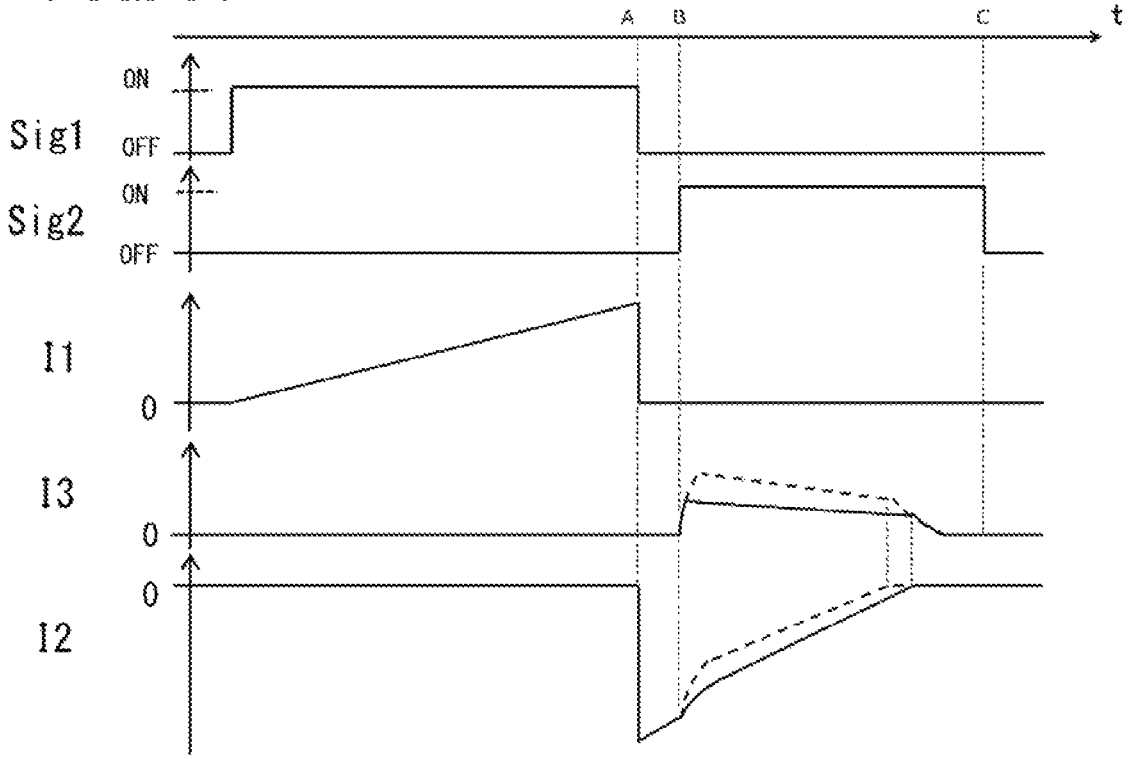
FIG. 11 is a chart representing a group of operation waveforms of the ignition apparatus according to Embodiment 5.

FIG. 11 is a chart representing a group of operation waveforms of the ignition apparatus according to Embodiment 5. FIG. 11 is a timing chart and represents, from top to bottom, the respective waveforms of the driving signal Sig1 for the first switching circuit 11, the driving signal Sig2 for the second switching circuit 31, the primary current I1 flowing in the primary coil 10, the tertiary current I3 flowing in the tertiary coil 30, and the secondary current I2 flowing in the secondary coil 20.

Because the basic operation is the same as that of each of Embodiments 1 and 2, the explanation for the operation will be omitted. In each of the respective waveforms of the tertiary current I3 and the secondary current I2, the broken-line waveform represents a current at a time when no tertiary current limiting resistor 32 is provided, and the solid-line waveform represents a current at a time when the tertiary current limiting resistor 32 is provided. When at the time point B, the second switching circuit 31 is turned on, the tertiary current I3 flows, and a voltage, which is determined by the tertiary current I3 and the resistance value of the tertiary current limiting resistor 32, is generated between the both ends of the tertiary current limiting resistor 32. In the case where the voltage generated between the both ends of the tertiary current limiting resistor 32 is larger than the voltage (electromotive force) generated between the both ends of the tertiary coil 30, no current can be made to flow in the tertiary coil; therefore, the tertiary current I3 is limited and hence the reduction amount of the secondary current I2 is also limited.

Embodiment 5 makes it possible that although the reduction of the secondary current suppresses the consumption of the ignition plug 21, the secondary current I2 does not decrease more than necessary and hence the energy required for ignition is held. As the method of limiting the tertiary current I3, not only the tertiary current limiting resistor 32 but also a rectifying device such as a diode may be utilized.

6. Embodiment 6

Figure 12:
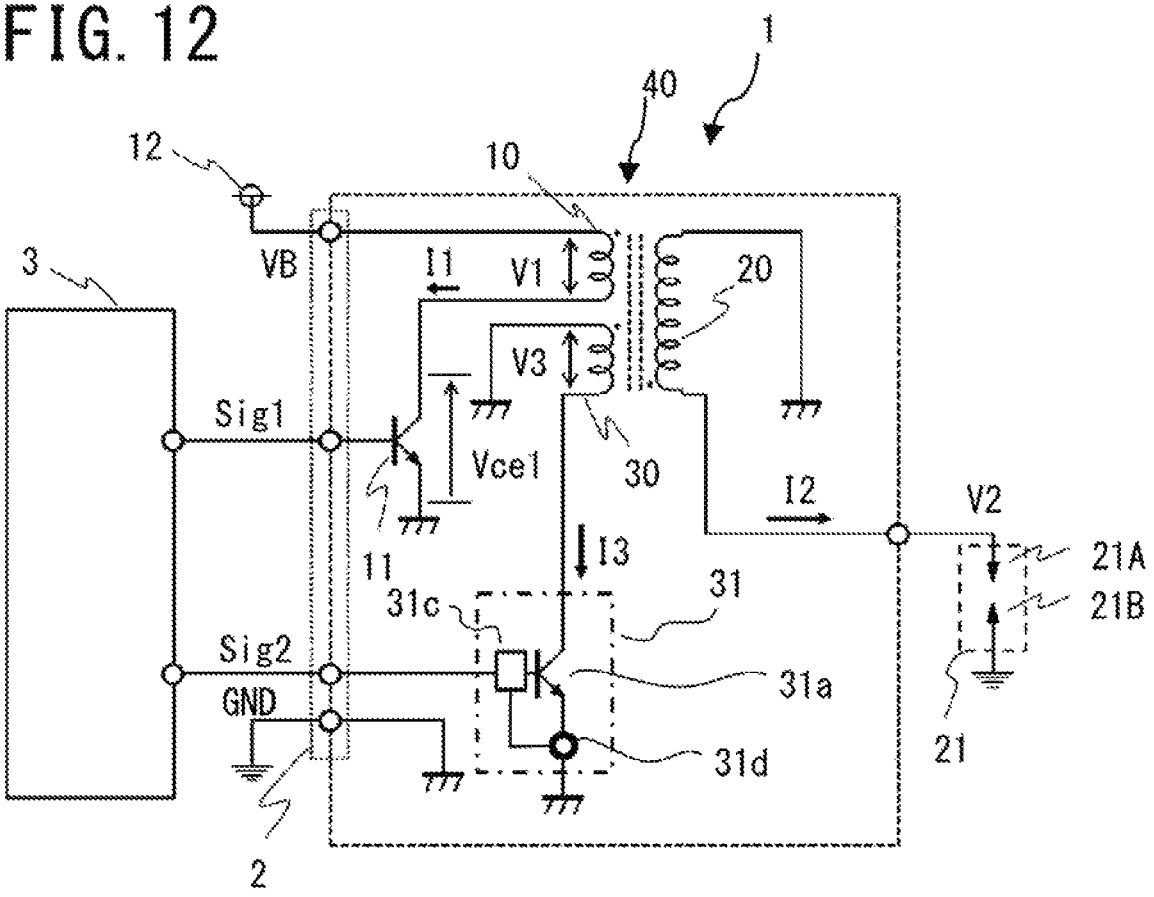
FIG. 12 is a circuit diagram of an ignition apparatus according to Embodiment 6.

FIG. 12 is a circuit diagram of an ignition apparatus according to Embodiment 6. The internal-combustion-engine ignition apparatus according to Embodiment 6 is different from the configuration according to Embodiment 5 in FIG. 10 in that a current limiting circuit, which replaces the tertiary current limiting resistor 32, is provided in the second switching circuit 31. The second switching circuit 31 is provided with the transistor 31*a*, a current control device 31*c*, and a current sensor 31*d*; the integration of these devices functions as a current limiting circuit. The current sensor 31*d* is provided between the emitter of the transistor 31*a* and the ground; the current control device 31*c* controls the output current of the transistor 31*a* in such a way that the tertiary current I3 detected by the current sensor 31*d* does not exceed a predetermined tertiary current limiting value IcI3. The current control device 31*c* may be formed by use of an operational amplifier or a current control IC. The current sensor 31*d* may be formed by use of a shunt resistor or a current probe.

Figure 13:
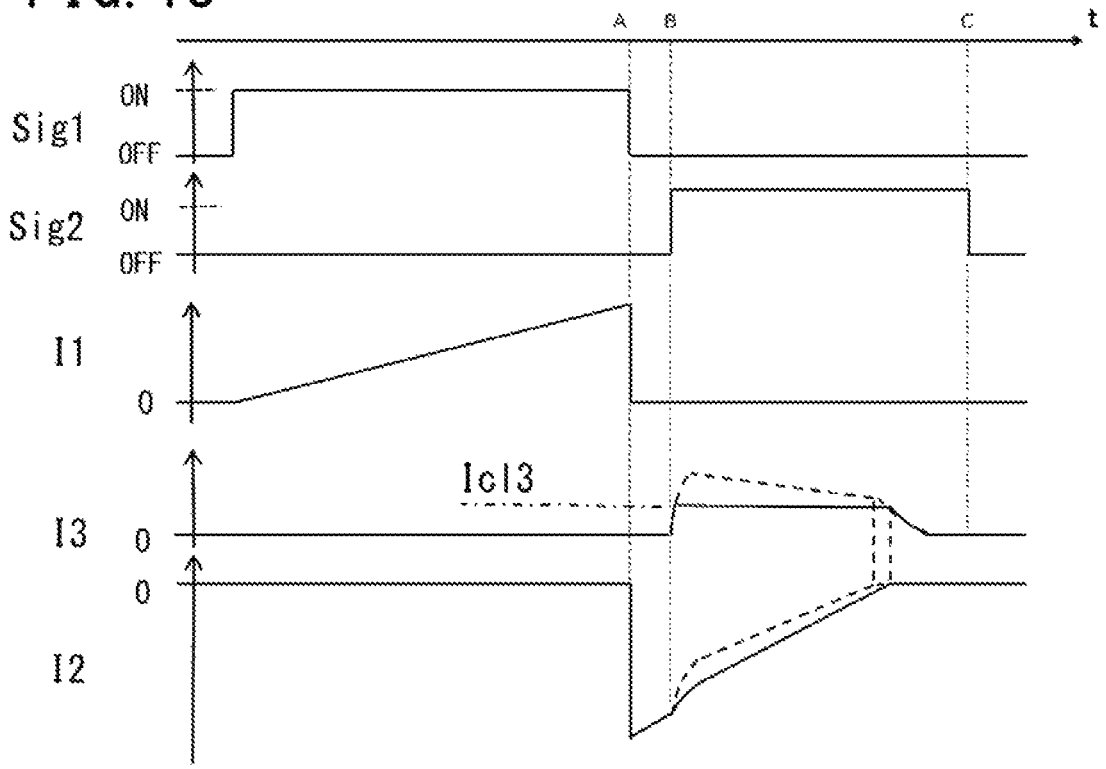
FIG. 13 is a chart representing a group of operation waveforms of the ignition apparatus according to Embodiment 6.

FIG. 13 is a chart representing a group of operation waveforms of the ignition apparatus according to Embodiment 6. Because the basic operation is the same as that of Embodiment 5 represented in FIG. 11, the explanation for the operation will be omitted. In each of the respective waveforms of the tertiary current I3 and the secondary current I2, the broken-line waveform represents a current at a time when no tertiary current limiting circuit is provided, and the solid-line waveform represents a current at a time when the tertiary current limiting circuit is provided. When at the time point B, the driving signal Sig2 for the second switching circuit 31 becomes ON, the second switching circuit 31 is turned on and hence the tertiary current I3 flows. The tertiary current is detected by the current sensor 31*d*, and the current control device 31*c* limits the maximum value thereof to the tertiary current limiting value IcI3.

Embodiment 6 makes it possible to limit the maximum value of the tertiary current; thus, it is made possible that although the reduction of the secondary current suppresses the consumption of the ignition plug 21, the secondary current I2 does not decrease more than necessary and hence the energy required for ignition is held.

In FIG. 12, there has been explained the case where the current limiting circuit is provided in the second switching circuit 31; however, there may be utilized a configuration in which the controller 3 receives the detection signal of the current sensor 31*d* and then controls the second switching circuit driving signal Sig2 so that the maximum value of the tertiary current I3 is limited.

7. Embodiment 7

Figure 14:
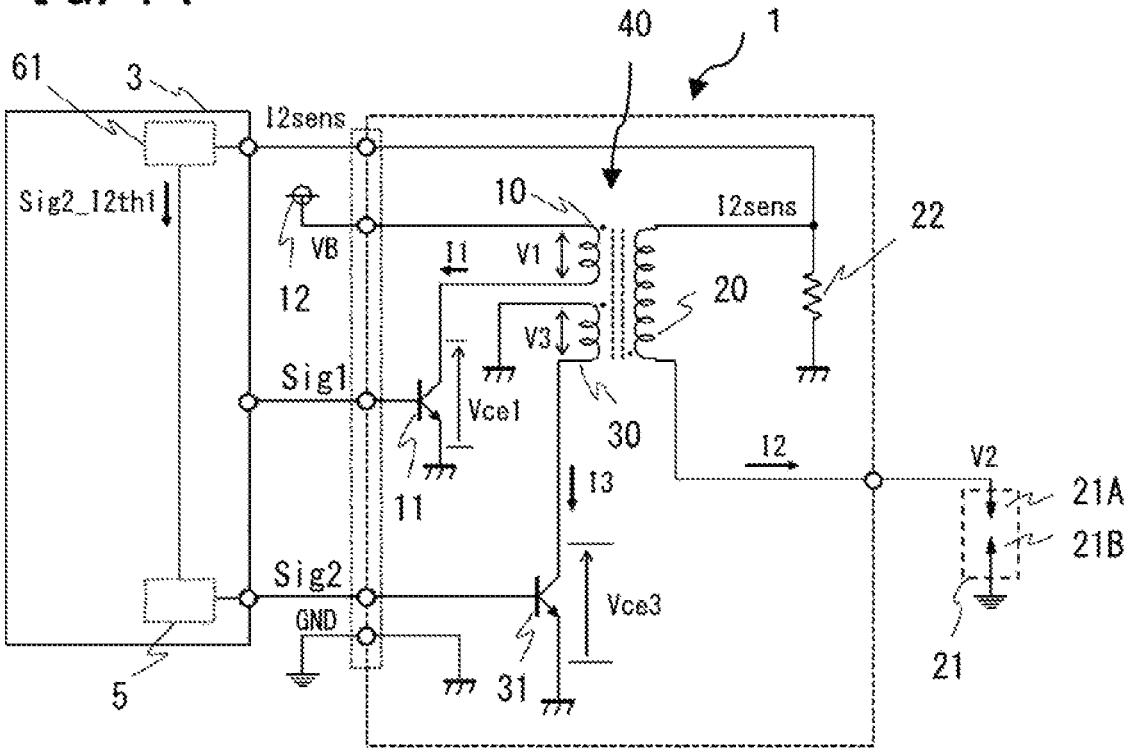
FIG. 14 is a circuit diagram of an ignition apparatus according to Embodiment 7.

FIG. 14 is a circuit diagram of an ignition apparatus according to Embodiment 7. The internal-combustion-engine ignition apparatus according to Embodiment 7 differs from the configuration according to Embodiment 2 in FIG. 5 in the following three points. The first point is that one end, of the secondary coil 20, that is earthed to the ground in FIG. 5 is earthed to the ground by way of a secondary current detection resistor 22 in FIG. 14. The second point is that in FIG. 14, a secondary current detection value I2sens, which is a voltage at a connection point where the secondary coil 20 and the secondary current detection resistor 22 are connected with each other, is transferred to the controller 3. The third point is that in FIG. 14, a current on/off determination block 61 and a second switching circuit control block 5 are described in the controller 3.

The current on/off determination block 61 in the controller 3 makes a current on/off determination signal Sig2_I2th1 become a high-level signal (ON output), when the secondary current detection value I2sens exceeds an on/off threshold value I2th1, and makes the current on/off determination signal Sig2_I2th1 become a low-level signal (OFF output), when the secondary current detection value I2sens becomes the same as or smaller than the on/off threshold value I2th1. In the example represented in FIG. 14, a determination delay is provided; when the state where the secondary current detection value I2sens exceeds the on/off threshold value I2th1 has continued for a high-current continuance time, the current on/off determination block 61 makes the current on/off determination signal Sig2_I2th1 become the high-level signal (ON output).

After receiving the current on/off determination signal Sig2_I2th1, the second switching circuit control block 5 makes the second switching circuit driving signal Sig2 become the high-level signal (ON output), when the current on/off determination signal Sig2_I2th1 is the high-level signal (ON output), and makes the second switching circuit driving signal Sig2 become the low-level signal (OFF output), when the current on/off determination signal Sig2_I2th1 is the low-level signal (OFF output).

Figure 15:
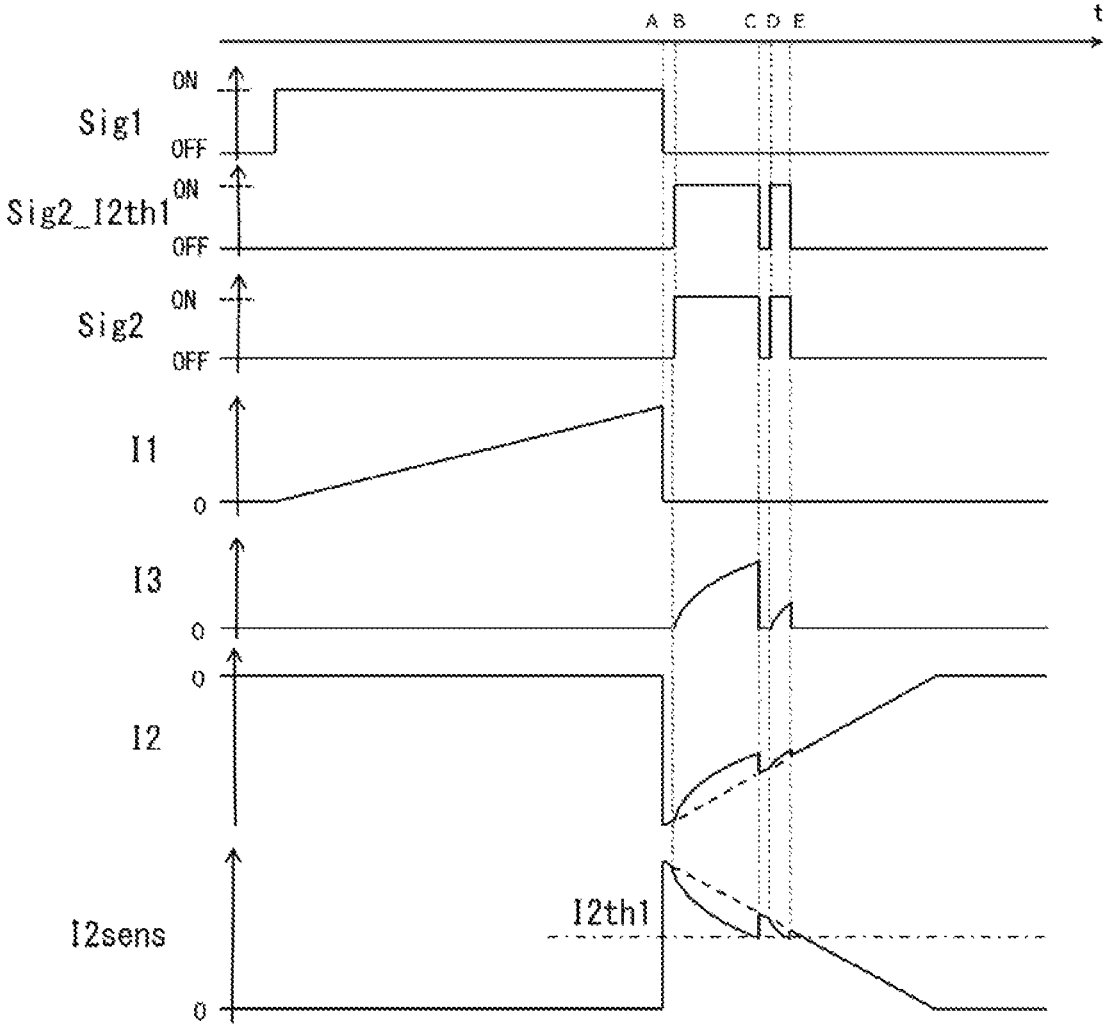
FIG. 15 is a chart representing a group of operation waveforms of the ignition apparatus according to Embodiment 7.

FIG. 15 is a chart representing a group of operation waveforms of the internal-combustion-engine ignition apparatus according to Embodiment 7. FIG. 15 is a timing chart and represents, from top to bottom, the respective waveforms of the driving signal Sig1 for the first switching circuit 11, the current on/off determination signal Sig2_I2th1, the driving signal Sig2 for the second switching circuit 31, the primary current I1 flowing in the primary coil 10, the tertiary current I3 flowing in the tertiary coil 30, the secondary current I2 flowing in the secondary coil 20, and the secondary current detection value I2sens. Because the basic operation is the same as that of Embodiment 5 represented in FIG. 11, the explanation for the basic operation will be omitted.

When energization of the primary coil 10 is cut off at the time point A, the secondary current I2 flows in the secondary coil 20; then, the secondary current I2 is detected by the secondary current detection resistor 22 and is converted into the secondary current detection value I2sens, so that a determination is made. The current on/off determination signal Sig2_I2th1 becomes the high-level signal (ON output) at the time point B until which the state where the secondary current detection value I2sens exceeds the on/off threshold value I2th1 has continued for the high-current continuance time; the second switching circuit control block 5 makes the driving signal Sig2 for the second switching circuit 31 become the high-level signal (ON output); the second switching circuit 31 is turned on; then, the tertiary current I3 flows in the tertiary coil 30. The tertiary current I3 makes the secondary current I2 decrease. Because at the time point C, the secondary current I2 decreases down to the on/off threshold value I2th1, the current on/off determination signal Sig2_I2th1 becomes the low-level signal (OFF output); the second switching circuit control block 5 makes the driving signal Sig2 for the second switching circuit 31 become the low-level signal (OFF output); then, the second switching circuit 31 is turned off. Accordingly, the tertiary current I3 becomes zero, and the secondary current I2 increases. Because the secondary current I2 continues to exceed the on/off threshold value I2th1 for the high-current continuance time, the second switching circuit 31 is turned on again at the time point D. Repetition of this operation makes it possible that the secondary current I2 maintains a current around the on/off threshold value I2th1. Because of its decrease after and including the time point E, the secondary current I2 does not continue to exceed the on/off threshold value I2th1 for the high-current continuance time; thus, the secondary current I2 gradually decreases without the second switching circuit 2 being turned on.

This operation makes it possible that consumption energy in an operation region where the secondary current I2 of a high value is not required is suppressed and hence the consumption of the plug is suppressed; thus, it is made possible that the secondary current I2 does not decrease more than necessary and hence the energy required for ignition is held.

The time difference between the time point A and the time point B is provided through the high-current continuance time in which the secondary current I2 continues to exceed the on/off threshold value I2th1; however, the time difference may be generated, for example, through a delay time due to the second switching circuit 31 itself or the control thereof. It may be allowed that instead of providing the high-current continuance time, a hysteresis is provided in the on/off threshold value I2th1 so that a dead zone is provided between a rising-side determination value and a falling-side determination value. Moreover, it may be allowed that there is implemented control in which the high-current continuance time is gradually shortened after generation of the secondary current so that the secondary current is controlled to take a value around the on/off threshold value I2th1.

8. Embodiment 8

Figure 16:
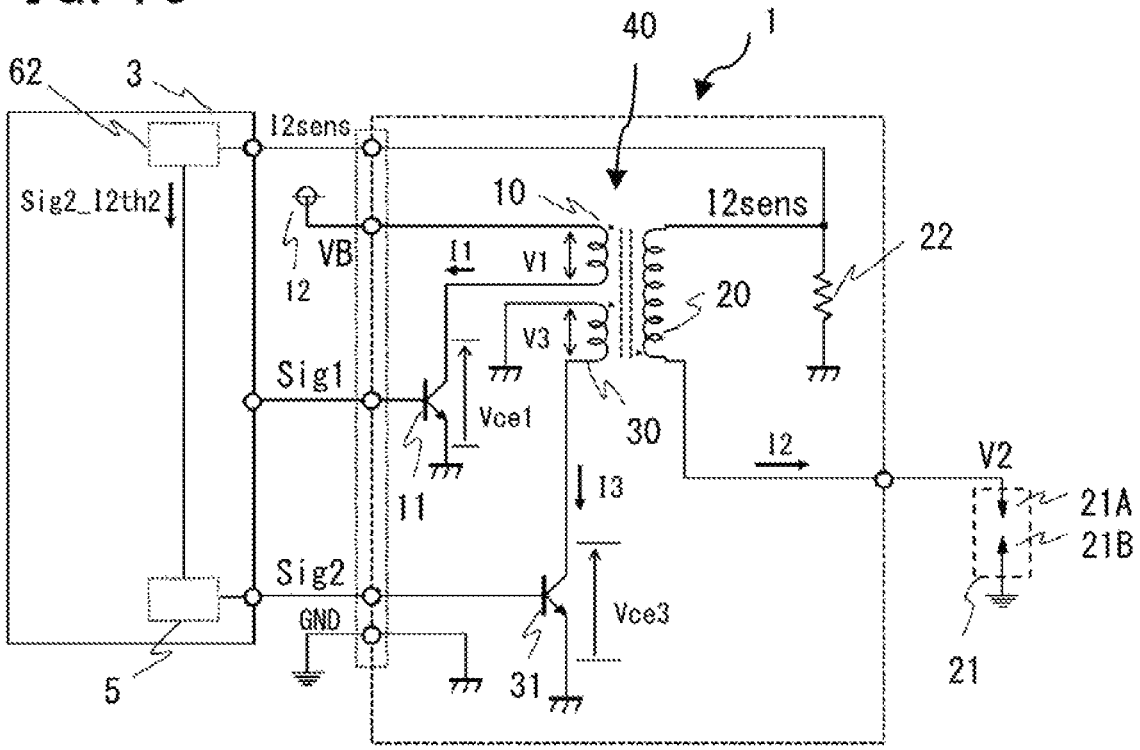
FIG. 16 is a circuit diagram of an ignition apparatus according to Embodiment 8.

FIG. 16 is a circuit diagram of an ignition apparatus according to Embodiment 8. The internal-combustion-engine ignition apparatus according to Embodiment 8 is different from the configuration according to Embodiment 7 in FIG. 14 in that the current on/off determination block 61 in the controller 3 is replaced by a current cutoff determination block 62.

The current cutoff determination block 62 performs the control in which the magnitude of the secondary current I2 is determined based on the secondary current detection value I2sens, in which when it is determined that the value of the secondary current I2 has changed from a value that exceeds a cutoff threshold value I2th2 to a value that is smaller than the cutoff threshold value I2th2, a current cutoff determination signal Sig2_I2th2, which becomes the high-level signal (ON output) for a predetermined cutoff time, is outputted to the second switching circuit control block 5 so as to make the second switching circuit driving signal Sig2 become the high-level signal (ON output), and in which the second switching circuit 31 for making the tertiary current I3 flow is turned on.

Figure 17:
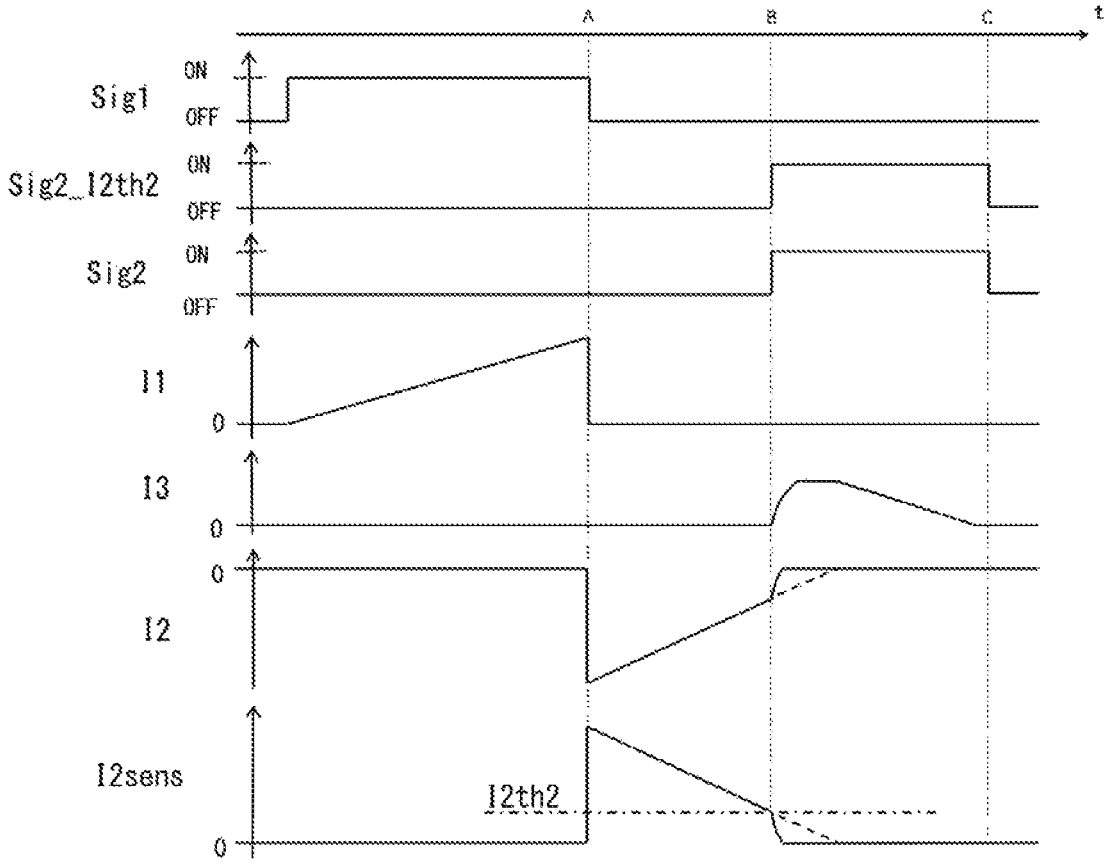
FIG. 17 is a chart representing a group of operation waveforms of the ignition apparatus according to Embodiment 8.

FIG. 17 is a chart representing a group of operation waveforms of the ignition apparatus according to Embodiment 8. FIG. 17 is a timing chart; because the basic operation is the same as that of Embodiment 7 represented in FIG. 15, the explanation for the basic operation will be omitted.

When energization of the primary coil 10 is cut off at the time point A, the secondary current I2 flows in the secondary coil 20; then, the secondary current I2 is detected by the secondary current detection resistor 22. When the secondary current I2 decreases and the value thereof changes from a value that exceeds a cutoff threshold value I2th2 to a value that is smaller than the cutoff threshold value I2th2 at the time point B, the current cutoff determination block 62 makes the current cutoff determination signal Sig2_I2th2 become the high-level signal (ON output) for the cutoff time. As a result, the second switching circuit driving signal Sig2 becomes the high-level signal (ON output) and hence the second switching circuit 31 for making the tertiary current I3 flow is turned on for the cutoff time. The tertiary current I3 makes the secondary current I2 decrease.

This operation makes it possible that the secondary current I2, which does not contribute to the combustion at the final stage of a discharge, is decreased and hence the discharge is cut off; as a result, the consumption energy can be suppressed. Moreover, it is made possible that a restrike, which may occur at the final stage of a discharge, is suppressed and hence the consumption of the plug is suppressed.

9. Embodiment 9

Figure 18:
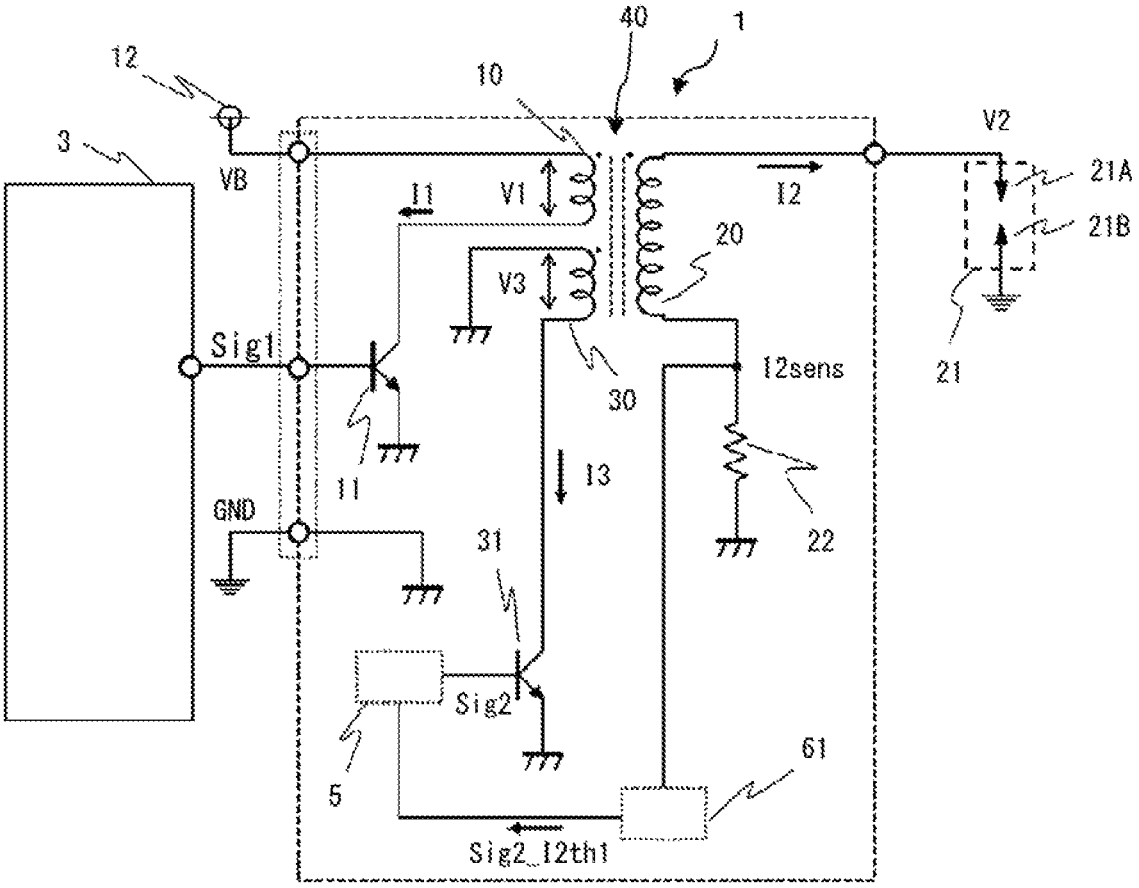
FIG. 18 is a circuit diagram of an ignition apparatus according to Embodiment 9.

FIG. 18 is a circuit diagram of an ignition apparatus according to Embodiment 9. The internal-combustion-engine ignition apparatus according to Embodiment 9 is different from the configuration according to Embodiment 7 in FIG. 14 in that the current on/off determination block 61 and the second switching circuit control block 5 are incorporated in the ignition coil 40. Each of the current on/off determination block 61 and the second switching circuit control block 5 may be formed of a digital electronic circuit such as an IC, may be formed of an analogue electronic circuit such as a comparator, an operational amplifier, or the like, or may be formed of both a digital electronic circuit and an analogue electronic circuit.

As is the case with Embodiment 7, the current on/off determination block 61 makes the current on/off determination signal Sig2_I2th1 become the high-level signal (ON output), when the state where the secondary current detection value I2sens exceeds an on/off threshold value I2th1 has continued for the high-current continuance time, and makes the current on/off determination signal Sig2_I2th1 become the low-level signal (OFF output), when the secondary current detection value I2sens becomes the same as or smaller than the on/off threshold value I2th1. After receiving the current on/off determination signal Sig2_I2th1, the second switching circuit control block 5 makes the second switching circuit driving signal Sig2 become the high-level signal (ON output), when the current on/off determination signal Sig2_I2th1 is the high-level signal (ON output), and makes the second switching circuit driving signal Sig2 become the low-level signal (OFF output), when the current on/off determination signal Sig2_I2th1 is the low-level signal (OFF output).

The configuration according to Embodiment 9 makes it possible to achieve a function the same as that of the configuration according to Embodiment 7 and to obtain the same effect. That is to say, it is made possible that consumption energy in an operation region where the secondary current I2 of a high value is not required is suppressed and hence the consumption of the plug is suppressed; thus, it is made possible that the secondary current I2 does not decrease more than necessary and hence the energy required for ignition is held. In addition, the connector pins for the second switching circuit driving signal Sig2 and the connector pins and the harness for the secondary current detection value I2sens can be eliminated; thus, in comparison with Embodiment 7, the whole apparatus can be downsized.

10. Embodiment 10

Figure 19:
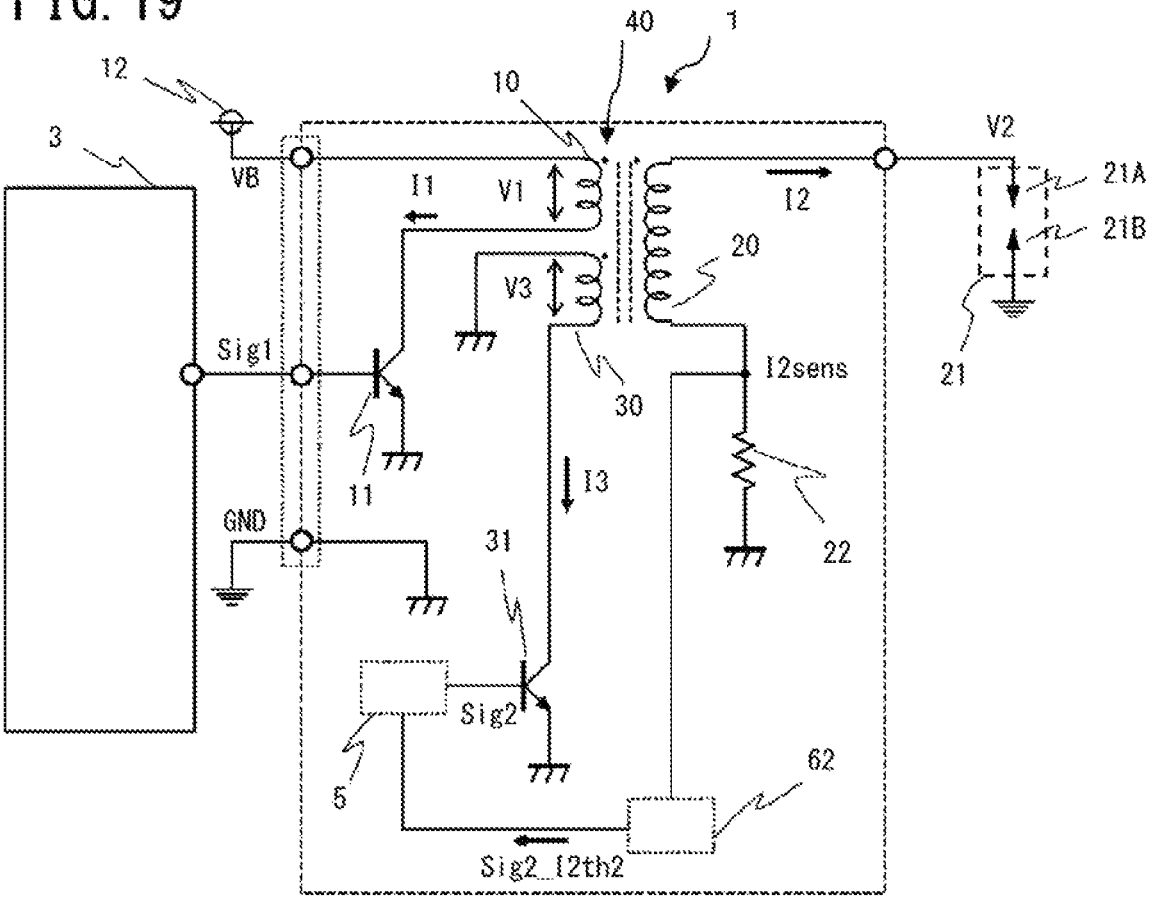
FIG. 19 is a circuit diagram of an ignition apparatus according to Embodiment 10.

FIG. 19 is a circuit diagram of an ignition apparatus according to Embodiment 10. The internal-combustion-engine ignition apparatus according to Embodiment 10 is different from the configuration according to Embodiment 8 in FIG. 16 in that the current cutoff determination block 62 and the second switching circuit control block 5 are incorporated in the ignition coil 40. Each of the current cutoff determination block 62 and the second switching circuit control block 5 may be formed of a digital electronic circuit such as an IC, may be formed of an analogue electronic circuit such as a comparator, an operational amplifier, or the like, or may be formed of both a digital electronic circuit and an analogue electronic circuit.

As is the case with Embodiment 8, the current cutoff determination block 62 performs the control in which when it is determined that the value of the secondary current I2 has changed from a value that exceeds the cutoff threshold value I2th2 to a value that is smaller than the cutoff threshold value I2th2, the current cutoff determination signal Sig2_I2th2, which becomes the high-level signal (ON output) for a predetermined cutoff time, is outputted to the second switching circuit control block 5 so as to make the second switching circuit driving signal Sig2 become the high-level signal (ON output), and in which the second switching circuit 31 for making the tertiary current I3 flow is turned on.

The configuration according to Embodiment 10 makes it possible to achieve a function the same as that of the configuration according to Embodiment 8 and to obtain the same effect. That is to say, the secondary current I2, which does not contribute to the combustion at the final stage of a discharge, is decreased and hence the discharge is cut off, so that the consumption energy can be suppressed. Moreover, it is made possible that a restrike, which may occur at the final stage of a discharge, is suppressed and hence the consumption of the plug is suppressed. In addition, the connector pins for the second switching circuit driving signal Sig2 and the connector pins and the harness for the secondary current detection value I2sens can be eliminated; thus, in comparison with Embodiment 8, the whole apparatus can be downsized.

11. Embodiment 11

Figure 20:
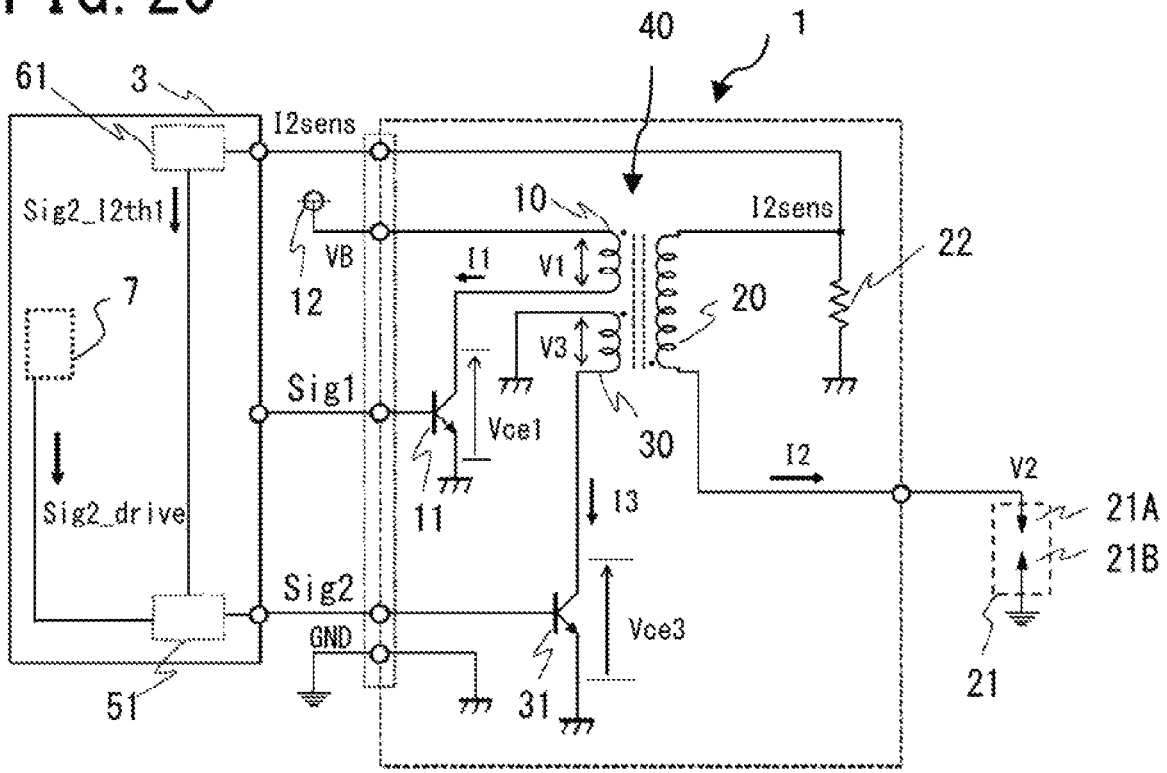
FIG. 20 is a circuit diagram of an ignition apparatus according to Embodiment 11.

FIG. 20 is a circuit diagram of an ignition apparatus according to Embodiment 11. The internal-combustion-engine ignition apparatus according to Embodiment 11 is different from the configuration according to Embodiment 7 in FIG. 14 in that there is performed the control in which instead of the second switching circuit control block 5, a complex-control second switching circuit control block 51 is provided and in which the second switching circuit driving signal Sig2 is determined by use of the current on/off determination signal Sig2_I2th1 and a driving state signal Sig2 drive based on a driving state. Through an AND determination based on the driving state signal Sig2 drive and the current on/off determination signal Sig2_I2th1, the complex-control second switching circuit control block 51 determines the second switching circuit driving signal Sig2. By use of at least one of information items, such as the load on a vehicle, the traveling speed, the crank angle of the engine, the rotation speed, the intake air amount, and the fuel supply amount, related to the driving state of the vehicle, a driving state determination block 7 produces the driving state signal Sig2 drive and transmits the driving state signal Sig2 drive to the complex-control second switching circuit control block 51.

Figure 21:
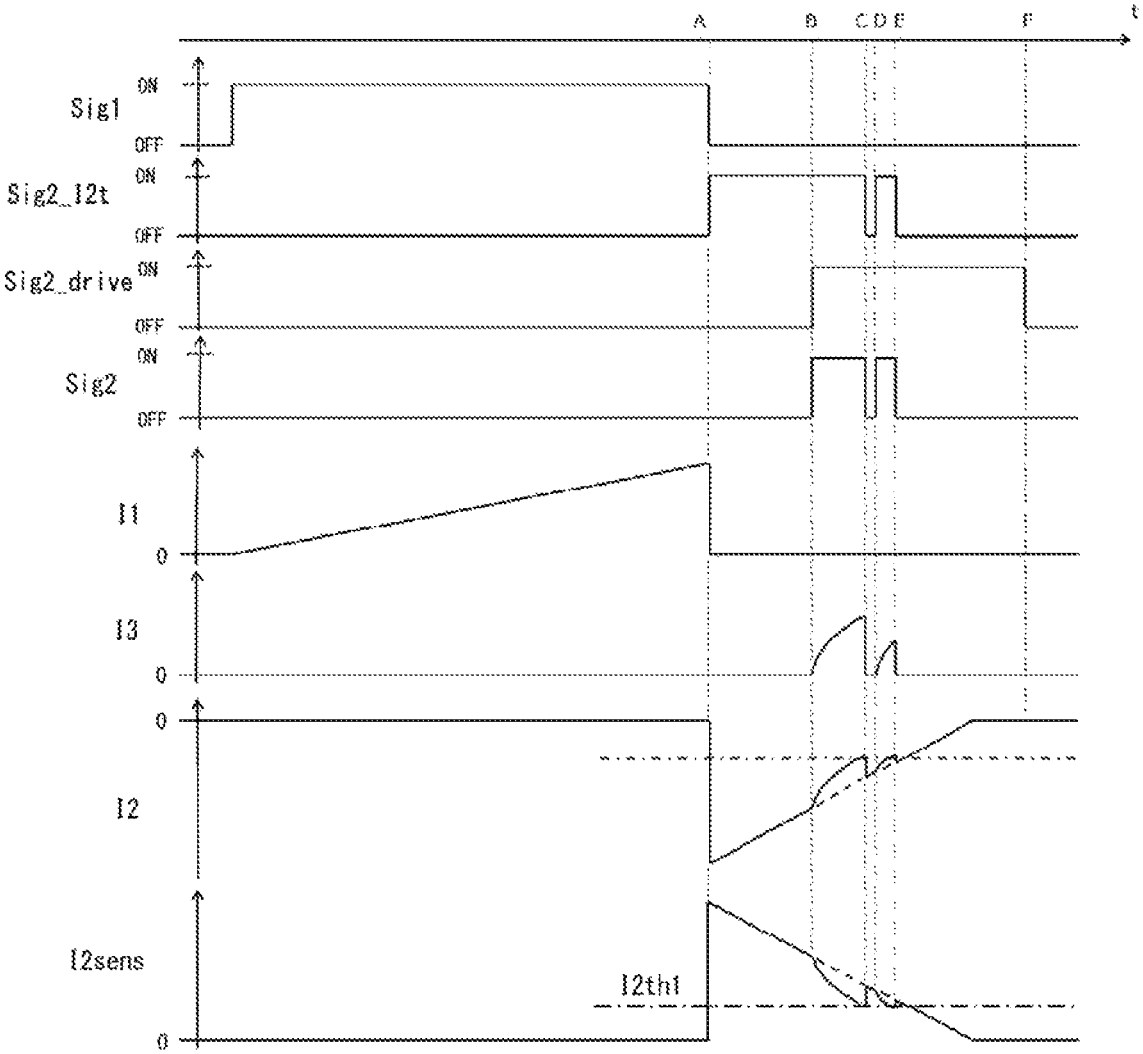
FIG. 21 is a chart representing a group of operation waveforms of the ignition apparatus according to Embodiment 11.

FIG. 21 is a chart representing a group of operation waveforms of the internal-combustion-engine ignition apparatus according to Embodiment 11. FIG. 21 is a timing chart and represents, from top to bottom, the respective waveforms of the driving signal Sig1 for the first switching circuit 11, the current on/off determination signal Sig2_I2th1, the driving state signal Sig2 drive, the driving signal Sig2 for the second switching circuit 31, the primary current I1 flowing in the primary coil 10, the tertiary current I3 flowing in the tertiary coil 30, the secondary current I2 flowing in the secondary coil 20, and the secondary current detection value I2sens. Because the basic operation is the same as that of Embodiment 7 represented in FIG. 15, the explanation for the basic operation will be omitted.

The secondary current I2 is detected by the secondary current detection resistor 22 and is converted into the secondary current detection value I2sens; then, the current on/off determination block 61 compares the secondary current detection value I2sens with the on/off threshold value I2th1. At the time point A, the current on/off determination signal Sig2_I2th1 is the high-level signal (ON output), because the secondary current detection value I2sens is larger than the on/off threshold value I2th1. However, because the driving state signal Sig2 drive based on a driving state is the low-level signal (OFF output) until the time point B, the current on/off determination signal Sig2_I2th1 is not reflected in the driving signal Sig2 for the second switching circuit 31. It is determined that the driving state is the one in which a high secondary current value is required immediately after a dielectric breakdown, and reduction of the secondary current I2 is neither permitted nor implemented in the period between the time point A and the time point B.

At the time point B in FIG. 21, the driving state signal Sig2 drive becomes the high-level signal (ON output), and the reduction of the secondary current is permitted. This is because it is determined that because the combustion state is stable in the period after the time point B, no problem is posed even when the secondary current is reduced. Accordingly, the secondary current detection value I2sens is compared with the on/off threshold value I2th1 so that secondary current reduction control is performed. In this case, the energization starting timing for the tertiary coil is substantially controlled by means of the driving state signal Sig2 drive.

In each of FIGS. 20 and 21, there has been described an example in which by use of at least one of information items, such as the load on a vehicle, the traveling speed, the rotation speed of the engine, the intake air amount, and the fuel supply amount, related to the driving state of the vehicle, it is determined whether or not the secondary current I2 can be reduced and then the energization permission period for the tertiary current is controlled. Furthermore, it may be allowed that based on the driving state of a vehicle, the energization period, the post-energization cutoff period, and the on/off repetition period of the tertiary current are determined and controlled.

According to Embodiment 11 makes it possible to obtain a desirable secondary-current decrease pattern in which based on the driving state of a vehicle, the energization starting timing, the energization period, the post-energization cutoff period, and the on/off repetition period of the tertiary current are optimized so that stable combustion is maintained while the consumption of the ignition plug 21 is suppressed. This operation makes it possible that consumption energy is suppressed and hence the consumption of the ignition plug is suppressed so that energy optimum for driving is applied.

Moreover, it may also be allowed that based on the driving state of a vehicle, the on/off threshold value I2th1 and the cutoff threshold value I2th2 are changed and hence the secondary-current decrease pattern is optimized so that while the consumption of the ignition plug is suppressed, stable combustion is maintained.

12. Embodiment 12

<High-Primary-Voltage-ON Control>

Figure 22:
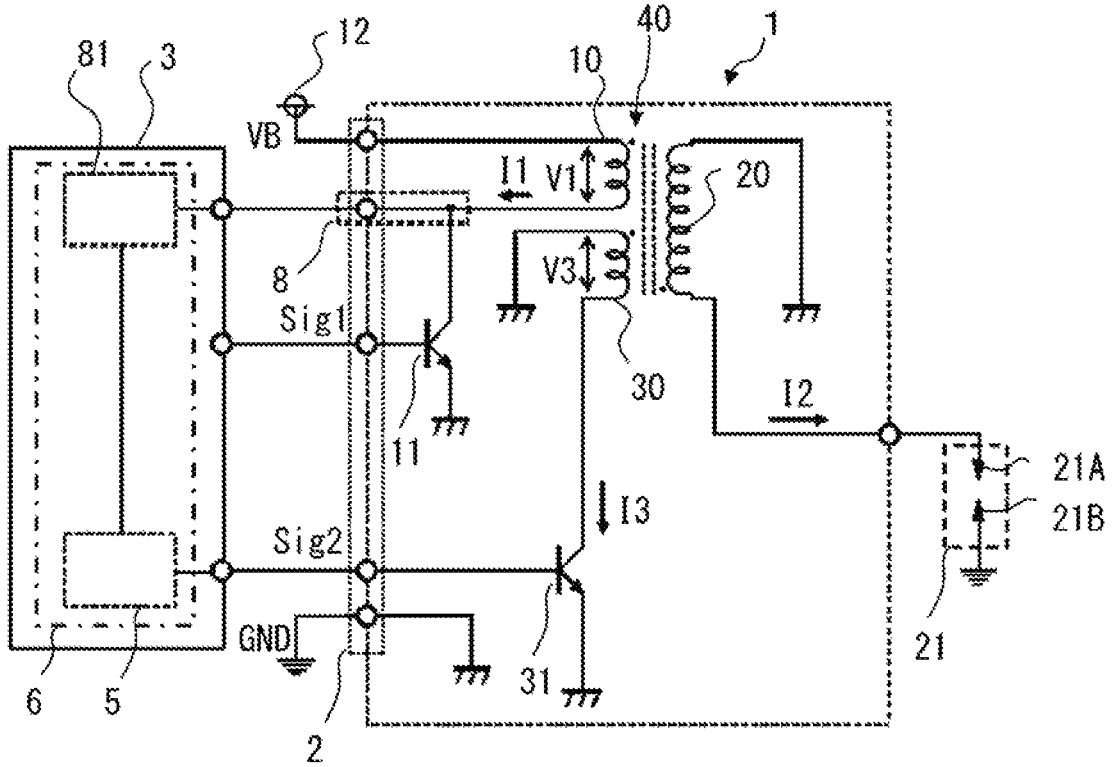
FIG. 22 is a circuit diagram of an ignition apparatus according to Embodiment 12.
Figure 23:
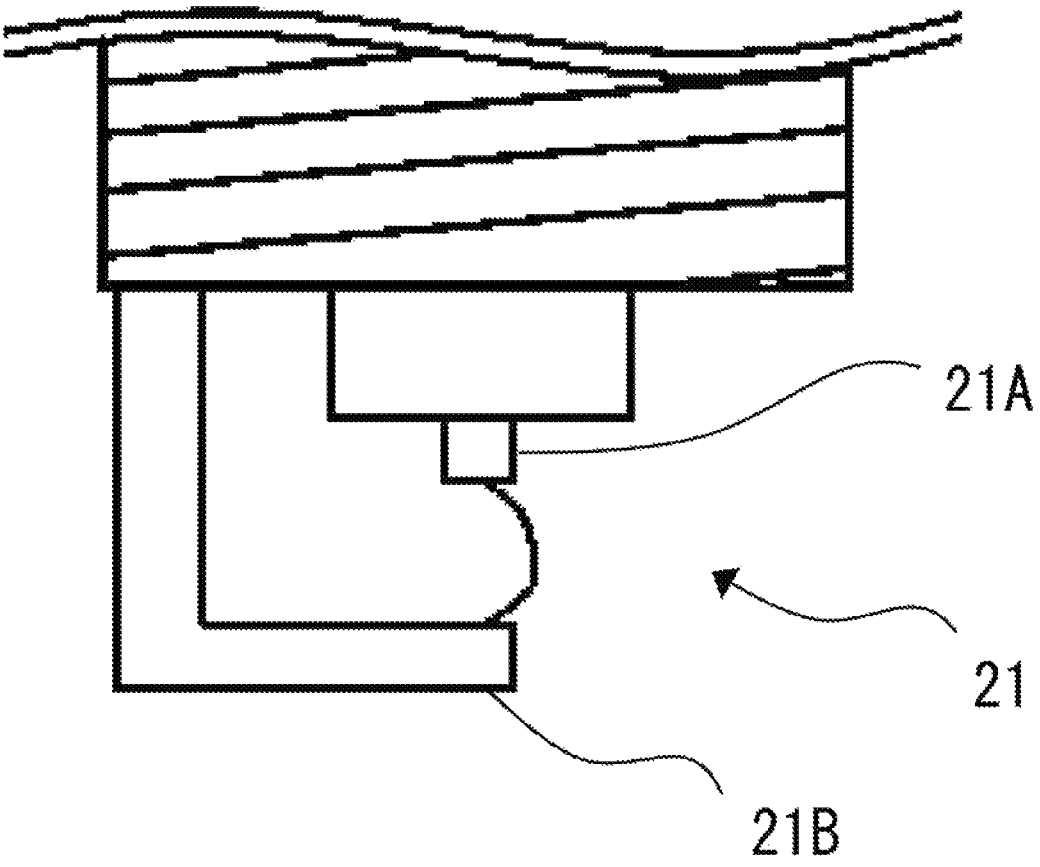
FIG. 23 is a view illustrating a state where a discharging path of an ignition plug according to Embodiment 12 is short.
Figure 24:
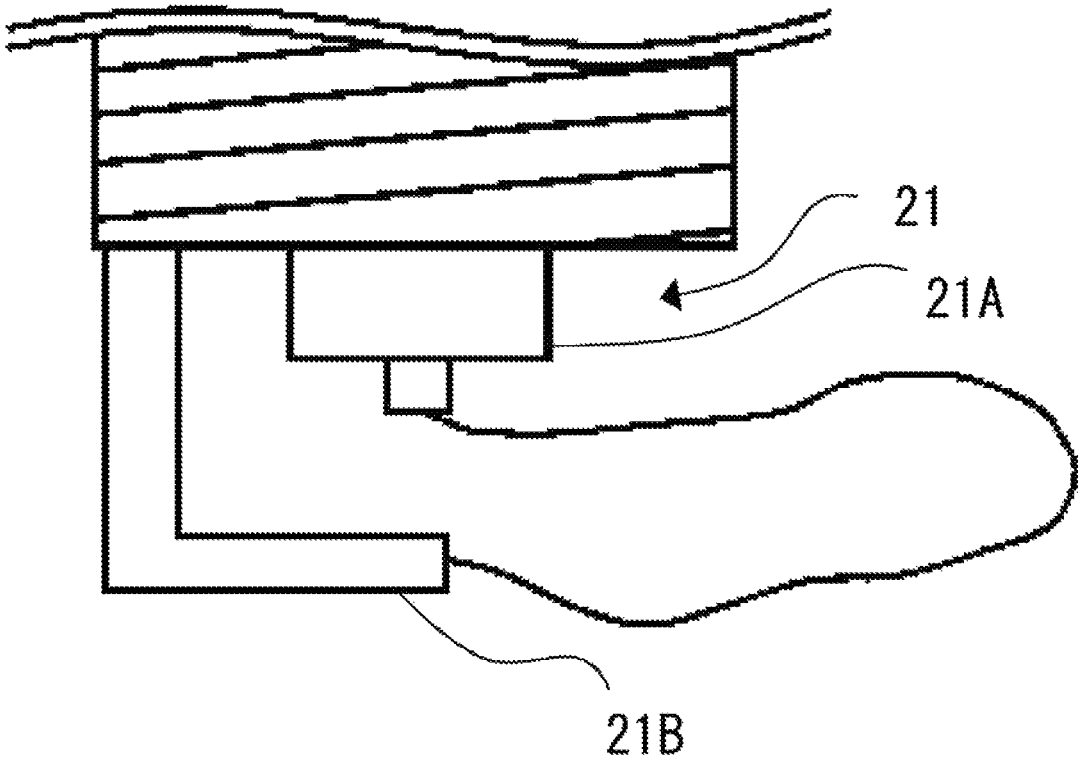
FIG. 24 is a view illustrating a state where the discharging path of the ignition plug according to Embodiment 12 is long.
Figure 25:
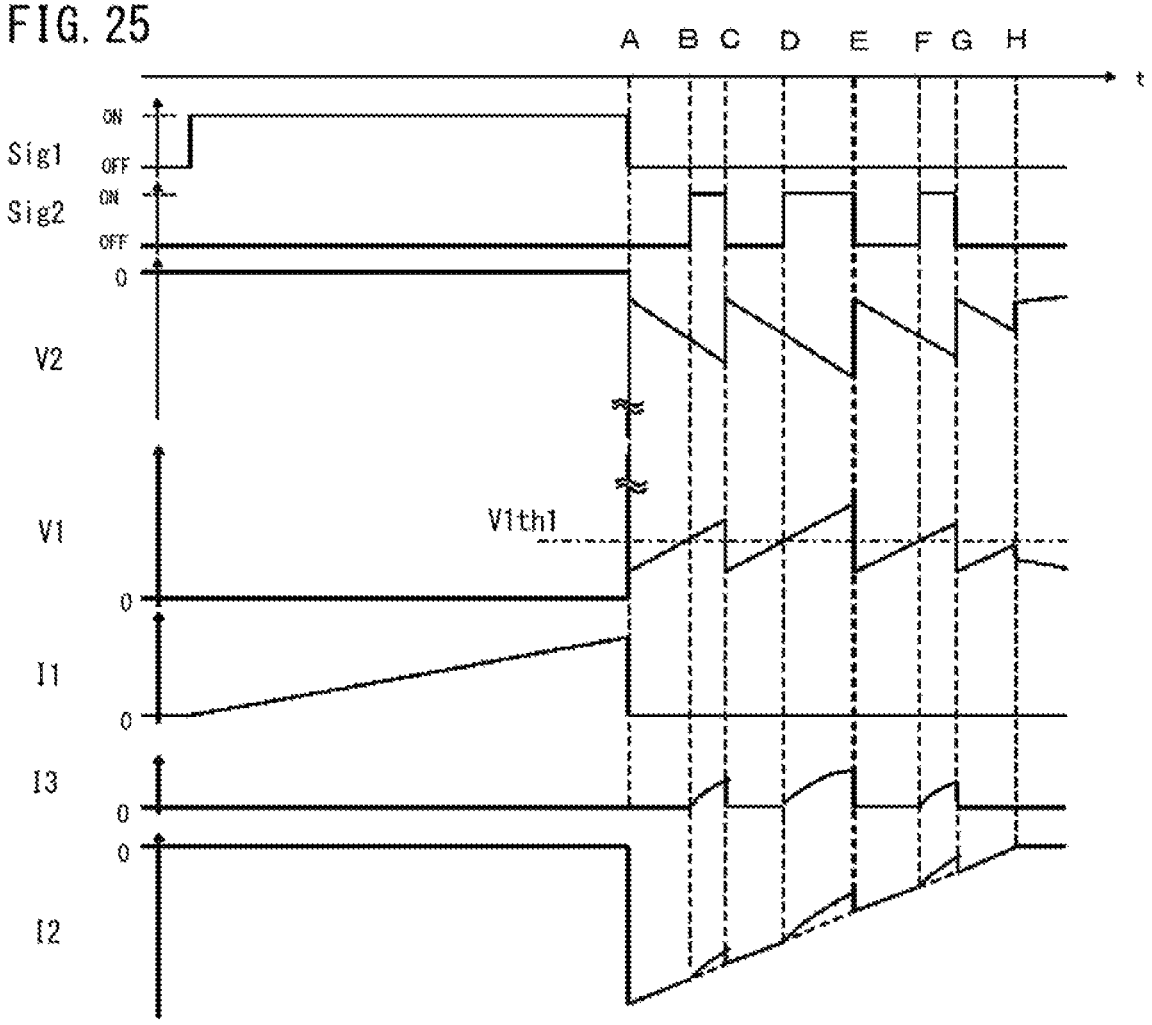
FIG. 25 is a chart representing a group of operation waveforms of high-primary-voltage-ON control in the ignition apparatus according to Embodiment 12.

FIG. 22 is a circuit diagram of an ignition apparatus according to Embodiment 12. FIG. 23 is a view illustrating a state where a discharging path of the ignition plug 21 according to Embodiment 12 is short. FIG. 24 is a view illustrating a state where the discharging path of the ignition plug 21 according to Embodiment 12 is long. FIG. 25 is a chart representing a group of operation waveforms of high-primary-voltage-ON control in the ignition apparatus according to Embodiment 12.

An internal-combustion-engine ignition apparatus according to Embodiment 12 represented in FIG. 22 differs from the configuration according to Embodiment 2 represented in FIG. 5 in that the voltage at the connection point between the low-voltage side of the primary coil and the first switching circuit 11 is transferred to the controller 3 through a connection line 8 and in that a primary coil voltage detection circuit 81 and the second switching circuit control block 5 are described in the controller 3. The primary coil voltage detection circuit 81 detects a primary voltage V1 to be generated across the terminals of the primary coil 10 (referred to as a primary voltage V1, hereinafter) and then transfers the result of a comparison with a high-primary-voltage on/off threshold value V1th1 to the second switching circuit control block 5. The second switching circuit control block 5 drives the second switching circuit 31. The second switching circuit 31 performs on/off-switching of the energization of the tertiary coil 30 so as to decrease the secondary current in the secondary coil 20. In this situation, the primary coil voltage detection circuit 81 and the second switching circuit control block 5, in the controller 3, that determine energization of the tertiary coil 30 are collectively referred to as a tertiary coil control unit 6.

The inter-gap voltage (secondary voltage V2) of the ignition plug 21 changes due to the air flow, the temperature, the pressure, and the like in a cylinder; when the value (absolute value) of the secondary voltage V2 becomes large, the primary voltage V1 to be generated across the primary coil 10 also becomes large in a proportional manner, due to the transformer structure of the ignition coil 40. FIG. 23 illustrates a state where the discharging path of the ignition plug 21 is short. FIG. 23 illustrates the state where a spark discharge is produced in a space between the first electrode 21A and the second electrode 21B of the ignition plug 21, which face each other via a gap. When the air flow in a cylinder is strong, the discharging path of a spark discharge across the gap of the ignition plug 21 is extended, as illustrated in FIG. 24. As the discharging path becomes longer, the value of the secondary voltage V2 increases and hence the value of the primary voltage V1 increases. The necessity of the secondary current changes depending on the degree of extension of the discharging path of the spark discharge. It is desired that in a specific operation state of an internal combustion engine, the secondary current is decreased by energizing the tertiary coil 30 in accordance with the degree of extension of the discharging path of the spark discharge.

After energization of the primary coil 10 is cut off and the secondary current is generated, the tertiary coil control unit 6 in the controller 3 detects the primary voltage V1 and compares the primary voltage V1 with the high-primary-voltage on/off threshold value V1th1. When the primary voltage V1 exceeds the high-primary-voltage on/off threshold value V1th1, the tertiary coil control unit 6 turns on the second switching circuit 31. When the primary voltage V1 is the same as or lower than the high-primary-voltage on/off threshold value V1th1, the tertiary coil control unit 6 turns off the second switching circuit 31. While the second switching circuit 31 energizes the tertiary coil 30, the secondary current that flows in the secondary coil 20 can be decreased.

This configuration makes it possible that based on the primary voltage V1 proportional to the length of the discharging path of a spark discharge, the tertiary coil 30 can appropriately be energized in accordance with the necessity of reduction of the secondary current for the spark discharge that changes depending on the degree of extension of the discharging path. Under a driving condition where the discharging path is long and hence sufficient ignitability can be secured, it is not required that when the discharging path is long, an excessive secondary current is made to flow. As such a driving condition, for example, there exists a high-load case where the filling efficiency of a fuel-air mixture to be filled into a cylinder is high or a case where the fuel-air mixture in the cylinder is rich.

It may be assumed that the high-primary-voltage on/off threshold value V1th1 changes in accordance with the operation state of an internal combustion engine, such as the filling efficiency, the air-fuel ratio, and the rotation speed.

This configuration makes it possible that when the primary voltage V1 exceeds the high-primary-voltage on/off threshold value V1th1 and hence it can be determined that the discharging path is long, the tertiary coil 30 is energized to decrease the secondary current flowing in the secondary coil 20 so that consumption of the ignition plug 21 is suppressed from increasing.

The behavior of the high-primary-voltage-ON control will be explained by use of a timing chart represented in FIG. 25. At the left end of FIG. 25, the driving signal Sig1 to the first switching circuit 11 is switched from OFF to ON, so that the primary coil 10 is energized and then the primary current I1 flows. After that, the driving signal Sig1 is switched from ON to OFF at the time point A, so that the energization of the primary coil 10 is cut off. As a result, the secondary voltage V2, which is a negative high voltage, is generated across the secondary coil 20 and then is applied to the first electrode 21A of the ignition plug 21; the electric potential of the first electrode 21A steeply falls (increases toward the minus side) and then reaches the dielectric breakdown voltage. Then, a spark discharge is produced across the gap between the first electrode 21A and the second electrode 21B of the ignition plug 21. When the spark discharge starts, the secondary voltage V2 rises (the absolute value thereof decreases) from the dielectric breakdown voltage and becomes a discharge maintaining voltage.

When the spark discharge starts at the time point A, the secondary current I2 rises in a step manner from zero toward the minus side; after that, as magnetic energy that has been stored in the iron core decreases, the absolute value of the electric current gradually decreases; then, at the time point H, the secondary current I2 becomes zero and the spark discharge ends.

In the example illustrated in FIG. 24, the flow of a fuel-air mixture is large and hence the discharging path gradually extends after the spark discharge has started; in response to the extension of the discharging path, the secondary voltage V2 gradually falls (increases toward the minus side). Due to the transformer structure of the ignition coil 40, the primary voltage V1 also changes in proportion to the positive/negative inversion value of the secondary voltage V2; the primary voltage V1 gradually increases in response to the extension of the discharging path.

In the example in FIG. 25, at the time points C, E, and G, the spark discharge is blown off; the length of the discharging path is shortened each time the spark discharge is blown off and then gradually extends. Accordingly, the respective values of the secondary voltage V2 and the primary voltage V1 also decrease temporarily at the time points C, E, and G and then gradually increase.

Because after the discharge has started, the primary voltage V1 is lower than the high-primary-voltage on/off threshold value V1th1 in the interval from the time point immediately after the time point A to the time point B, the tertiary coil control unit 6 maintains the OFF-state of the driving signal Sig2 to the second switching circuit 31; because the primary voltage V1 is higher than the high-primary-voltage on/off threshold value V1th1 in the interval from the time point B to the time point C, the tertiary coil control unit 6 switches the driving signal Sig2 to the second switching circuit 31 from OFF to ON, so that the tertiary coil 30 is energized and hence the tertiary current I3 flows in the tertiary coil 30. As a result, the secondary current flowing in the secondary coil 20 is decreased.

Due to the extension of the discharging path, the primary voltage V1 exceeds the high-primary-voltage on/off threshold value V1th1 in the interval from the time point B to the time point C; however, in the case where the discharging path is long and the ignitability can be secured, the tertiary coil control unit 6 can suppress the consumption of the ignition plug 21 from increasing, by energizing the tertiary coil 30 so as to decrease the secondary current flowing in the secondary coil 20.

When at the time point C, due to the blow-off of the spark discharge, the primary voltage V1 falls and becomes lower than the high-primary-voltage on/off threshold value V1th1, the tertiary coil control unit 6 again switches the driving signal Sig2 to the second switching circuit 31 from ON to OFF so as to stop the energization of the tertiary coil 30. Then, when at the time point D, due to the extension of the discharging path, the primary voltage V1 becomes higher than the high-primary-voltage on/off threshold value V1th1, the tertiary coil control unit 6 switches the driving signal Sig2 to the second switching circuit 31 from OFF to ON so as to energize the tertiary coil 30. Because at the time point E, the spark discharge is blown off again, the energization of the tertiary coil 30 is stopped in the same manner; then, at the time point F, the tertiary coil 30 is energized due to extension of the discharging path. As described above, even when a spark-discharge blow-off occurs, the energization of the tertiary coil 30 can appropriately be switched on or off, based on the primary voltage V1 and in response to the extension of the discharging path.

13. Embodiment 13

<Low-Primary-Voltage-ON Control>

Figure 26:
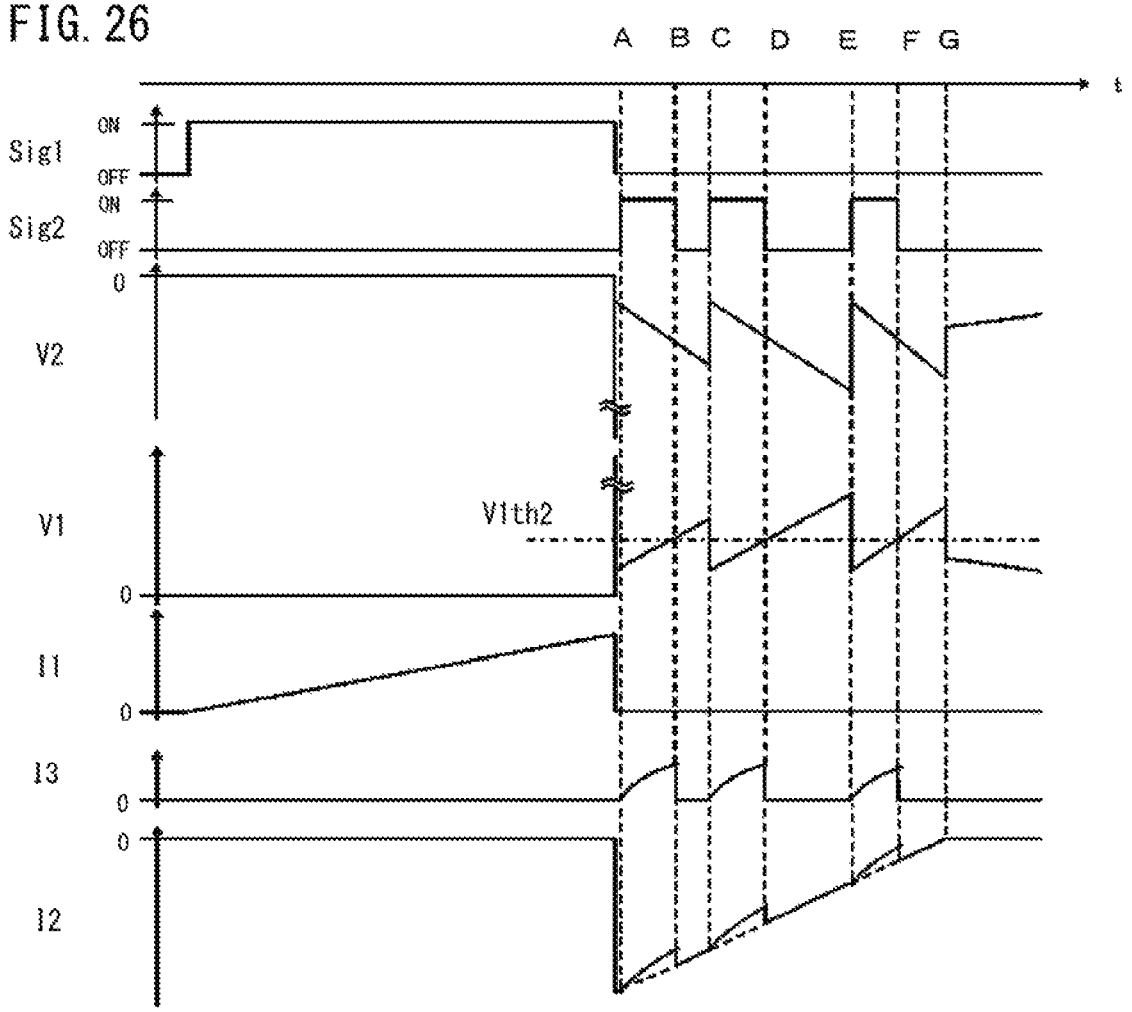
FIG. 26 is a chart representing a group of operation waveforms of low-primary-voltage-ON control in an ignition apparatus according to Embodiment 13.

The hardware configuration of an ignition apparatus according to Embodiment 13 is the same as that according to Embodiment 12, and the circuit diagram thereof is the same as that represented in FIG. 22; however, the function of the primary coil voltage detection circuit 81 is modified. FIG. 26 is a chart representing a group of operation waveforms of low-primary-voltage-ON control in the ignition apparatus according to Embodiment 13.

When a discharging path becomes long, the spark discharge is liable to be blown off; as a result, there exists a driving condition under which the ignitability is deteriorated. In that energization of the tertiary coil 30 is stopped and the level of the secondary current I2 is kept high, so that it is made possible that the spark discharge becomes less likely to be blown off and hence the ignitability is maintained. As such a driving condition, for example, there exists a case where the rotation speed of an internal combustion engine is in a high rotation speed region. In a high rotation speed region, an in-cylinder flow becomes too large, and hence a spark discharge becomes liable to be blown off. Because in a high rotation speed region, it is required that in order to complete combustion during a short power stroke, a spark discharge is maintained without being interrupted, it is desired to suppress the spark discharge from being blown off.

Accordingly, after the secondary current I2 is generated, the tertiary coil control unit 6 detects the primary voltage V1; in the case where the primary voltage V1 is higher than a low-primary-voltage cutoff threshold value V1th2, the second switching circuit 31 is turned off so that energization of the tertiary coil 30 is cut off; in the case where the primary voltage V1 to be generated across the primary coil is lower than the low-primary-voltage cutoff threshold value V1th2, the second switching circuit 31 is turned on so that energization of the tertiary coil 30 is turned on. The low-primary-voltage cutoff threshold value V1th2 may be changed in accordance with the operation state of an internal combustion engine, such as the filling efficiency, the air-fuel ratio, and rotation speed; the low-primary-voltage cutoff threshold value V1th2 and the high-primary-voltage on/off threshold value V1th1 may be set to one and the same value so as to be treated in a unified manner. Alternatively, the low-primary-voltage cutoff threshold value V1th2 and the high-primary-voltage on/off threshold value V1th1 may be set to respective different values.

In this configuration, because in the case where the primary voltage V1 is higher than the low-primary-voltage cutoff threshold value V1th2 and hence it can be determined that the discharging path has become long, the tertiary coil control unit 6 stops energization of the tertiary coil 30 so as to stop the secondary current I2 from being suppressed, it is made possible that the spark discharge is made less likely to be blown off and hence the ignitability is secured.

The operation of the low-primary-voltage-ON control will be explained by use of a timing chart represented in FIG. 26. When a spark discharge starts at the time point A, the secondary current I2 increases in the minus direction stepwise from zero; after that, as magnetic energy that has been stored in the iron core decreases, the secondary current I2 gradually decreases; then, at the time point G, the secondary current I2 becomes zero and the spark discharge ends.

In the example illustrated in FIG. 26, the in-cylinder flow is large and hence the discharging path gradually extends after the spark discharge has started; in response to the extension of the discharging path, the secondary voltage V2 gradually increases in the minus direction. Due to the transformer structure of the ignition coil 40, the primary voltage V1 also changes in proportion to the positive/negative inversion value of the secondary voltage V2; the primary voltage V1 gradually increases in response to the extension of the discharging path. At the time points C and E, the spark discharge is blown off; the length of the discharging path is shortened each time the spark discharge is blown off and then gradually extends. Accordingly, the respective values of the secondary voltage V2 and the primary voltage V1 also decrease temporarily at the time points C and E and then gradually increase.

Because the primary voltage V1 is lower than the low-primary-voltage cutoff threshold value V1th2 in the interval from the time point A to the time point B, the tertiary coil control unit 6 turns on the driving signal Sig2 to the second switching circuit 31 and energizes the tertiary coil 30 so as to make the tertiary current I3 flow in the tertiary coil 30, so that the secondary current is decreased. In the case where the discharging path is not long and hence the spark discharge is not liable to be blown off, the tertiary coil control unit 6 energizes the tertiary coil 30. As a result, the tertiary coil control unit 6 can suppress consumption of the ignition plug 21 from increasing, by decreasing the secondary current flowing in the secondary coil 20.

In contrast, because due to extension of the discharging path, the primary voltage V1 is higher than the low-primary-voltage cutoff threshold value V1th2 in the interval from the time point B to the time point C, the tertiary coil control unit 6 switches the driving signal Sig2 to the second switching circuit 31 from ON to OFF. The tertiary coil control unit 6 stops the energization of the tertiary coil 30 so as to stop the tertiary current I3 flowing in the tertiary coil 30. As a result, the secondary coil 20 is stopped from decreasing. Accordingly, because in the case where the discharging path becomes long and hence the spark discharge is liable to be blown off, the tertiary coil control unit 6 keeps the level of the secondary current high, it is made possible that the spark discharge is made less likely to be blown off and hence the ignitability is secured.

When at the time point C, due to the blow-off of the spark discharge, the primary voltage V1 falls and becomes lower than the low-primary-voltage cutoff threshold value V1th2, the tertiary coil control unit 6 again switches the driving signal Sig2 to the second switching circuit 31 from OFF to ON so as to energize the tertiary coil 30. Then, when at the time point D, due to the extension of the discharging path, the primary voltage V1 becomes higher than the low-primary-voltage cutoff threshold value V1th2, the tertiary coil control unit 6 switches the driving signal Sig2 to the second switching circuit 31 from ON to OFF so as to stop the energization of the tertiary coil 30. Because at the time point E, the spark discharge is blown off again, the tertiary coil control unit 6 energizes the tertiary coil 30 in the same manner; then, at the time point F, due to the extension of the discharging path, the energization of the tertiary coil 30 is stopped. As described above, even when a spark-discharge blow-off occurs, the tertiary coil control unit 6 can appropriately switch on or off the energization of the tertiary coil 30, based on the primary voltage V1 and in response to the extension of the discharging path.

14. Embodiment 14

<Switching Between Low-Primary-Voltage-ON Control and High-Primary-Voltage-ON Control in Accordance with Driving Condition>

Figure 27:
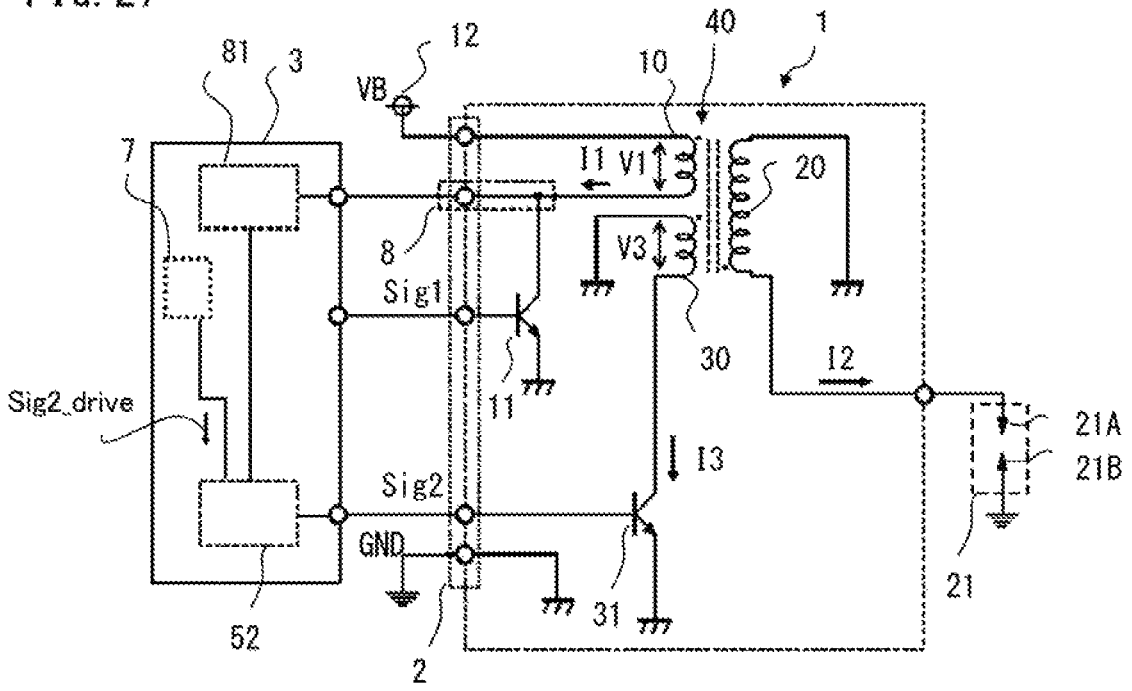
FIG. 27 is a circuit diagram of an ignition apparatus according to Embodiment 14.

Next, an ignition apparatus 1 according to Embodiment 14 will be explained. FIG. 27 is a circuit diagram of the ignition apparatus 1 according to Embodiment 14. FIG. 28 is a figure representing switching of control in accordance with an operation state in the ignition apparatus according to Embodiment 14.

In the circuit diagram of Embodiment 14 represented in FIG. 27, the second switching circuit control block 5 in FIG. 22, which is a circuit diagram of Embodiment 12, is replaced by a complex-control second switching circuit 52 and the driving state determination block 7. By use of at least one of information items, such as the load on a vehicle, the traveling speed, the crank angle of the engine, the rotation speed, the intake air amount, and the fuel supply amount, related to the driving state of the vehicle, the driving state determination block 7 produces the driving state signal Sig2 drive and transmits the driving state signal Sig2 drive to the complex-control second switching circuit 52. In Embodiment 14, in accordance with the condition under which the operation state of the internal combustion engine is in a first region or a second region, the controller 3 performs at least one of the low-primary-voltage-ON control and the high-primary-voltage-ON control. The driving state determination block 7 transfers whether or not the operation state is in a predetermined region to the complex-control second switching circuit 52. The primary coil voltage detection circuit 81 transfers a primary coil voltage to the complex-control second switching circuit 52. This configuration makes it possible that in accordance with the necessity that changes depending on the driving condition, energization control of the tertiary coil 30 is switched so that the ignitability and a suppression in the consumption of the ignition plug are concurrently realized.

The ignition apparatus 1 according to Embodiment 14 is provided with the driving state determination block 7 for detecting the operation state of an internal combustion engine equipped with the ignition apparatus 1 and the primary coil voltage detection circuit 81 for detecting the primary voltage V1 to be generated across the primary coil 10; the controller 3 performs at least one of the high-primary-voltage-ON control in which in the case where while the operation state is in a first operation region, the value of the primary voltage V1 detected by the primary coil voltage detection circuit 81 becomes lower than a preliminarily set high-primary-voltage on/off threshold value V1th1 after the secondary current I2 has been produced, the second switching circuit 31 is turned off and in the case where the value of the primary coil voltage becomes higher than the high-primary-voltage on/off threshold value V1th1, the second switching circuit 31 is turned on, and the low-primary-voltage-ON control in which while the operation state is in a second operation region, in the case where the value of the primary voltage V1 becomes lower than a preliminarily set low-primary-voltage cutoff threshold value V1th2 after the secondary current I2 has been produced, the second switching circuit 31 is turned on and in the case where the value of the primary coil voltage becomes higher than the low-primary-voltage cutoff threshold value V1th2, the second switching circuit 31 is turned off.

The controller 3 performs the high-primary-voltage-ON control, when a preliminarily set execution condition for the high-primary-voltage-ON control is established, and performs the low-primary-voltage-ON control, when a preliminarily set execution condition for the low-primary-voltage-ON control is established. For example, the execution condition for the low-primary-voltage-ON control includes a condition that is established when the filling efficiency of an internal combustion engine is within a preliminarily set high-load execution region and a condition that is established when the air-fuel ratio of an internal combustion engine is within a preliminarily set rich-air-fuel-ratio execution region. Moreover, the execution condition for the low-primary-voltage-ON control includes, for example, a condition that is established when the rotation speed of an internal combustion engine is within a preliminarily set high rotation speed region.

In FIG. 28, the execution condition for the high-primary-voltage-ON control and the execution condition for the low-primary-voltage-ON control will be explained. When a filling efficiency Ce of the internal combustion engine is expressed as $Ce1 \leq Ce < Ce2$ (e.g., $40\% \leq Ce < 90\%$), which suggests that the filling efficiency Ce is in a high-load region, the high-primary-voltage-ON control is performed. When an air-fuel ratio coefficient Kaf of the internal combustion engine is expressed as $Kaf1 \leq Kaf < Kaf2$ (e.g., $1.1 \leq Kaf < 1.4$), which suggests that the air-fuel ratio coefficient Kaf is in a rich region, the high-primary-voltage-ON control is performed. When a rotation speed Ne of the internal combustion engine is expressed as $Ne1 \leq Ne < Ne2$ (e.g., 4000 rpm$\leq$Ne<6000 rpm), which suggests that the rotation speed Ne is in a high-speed region, the low-primary-voltage-ON control is performed. Ce1, Ce2, Kaf1, Kaf2, Ne1, and Ne2 can freely be set; however, they may be set by experimentally obtaining the region in which the high-primary-voltage-ON control or the low-primary-voltage-ON control effectively functions.

The foregoing high-primary-voltage-ON control or low-primary-voltage-ON control may exclusively be executed. In addition, it may be allowed to define a region in which the high-primary-voltage-ON control and the low-primary-voltage-ON control are concurrently executed.

15. Embodiment 15

<High-Primary-Voltage-ON Control Corresponding to Peak Value of Primary Voltage>

Figure 29:
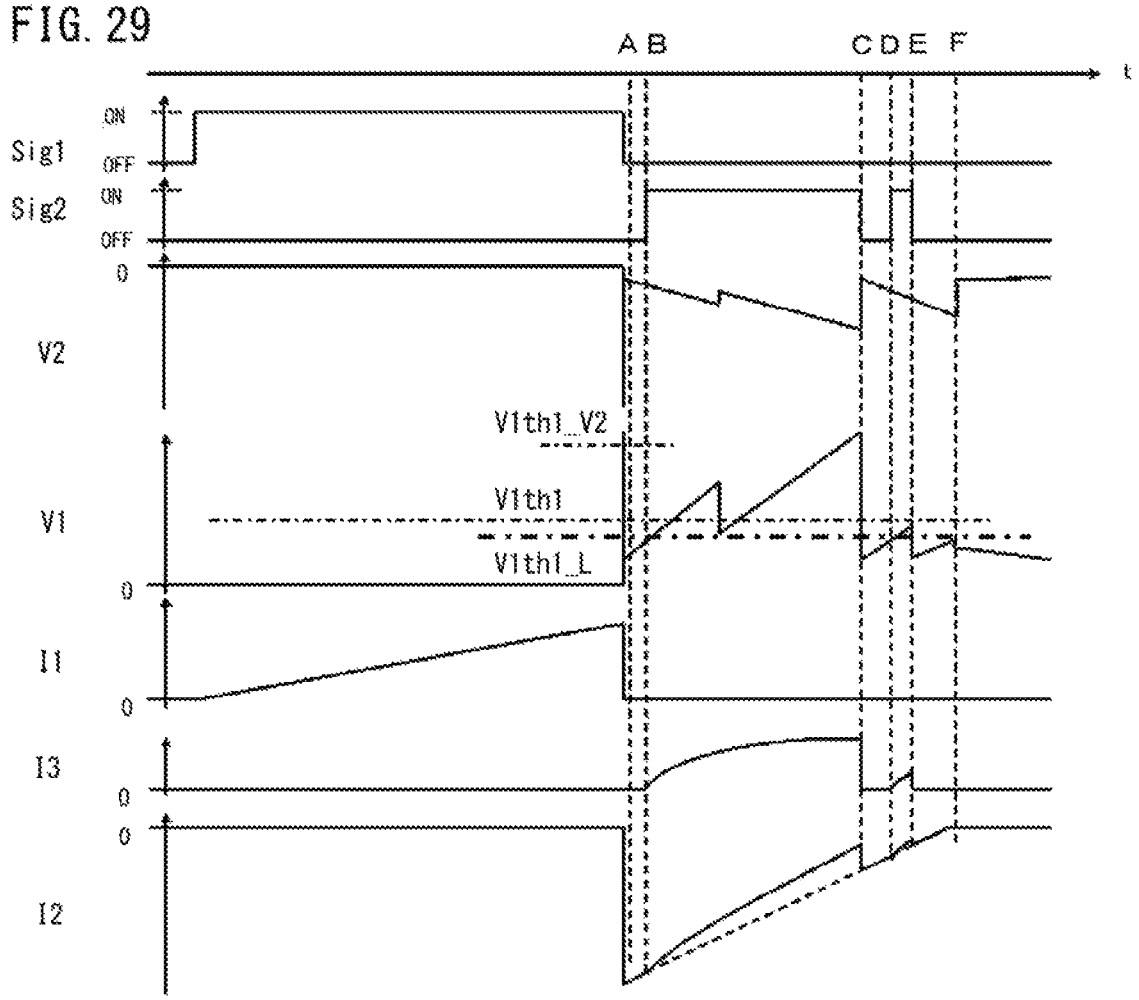
FIG. 29 is a chart representing a group of operation waveforms at a time when a peak value of the primary voltage in an ignition apparatus according to Embodiment 15 is larger than a determination value.
Figure 30:
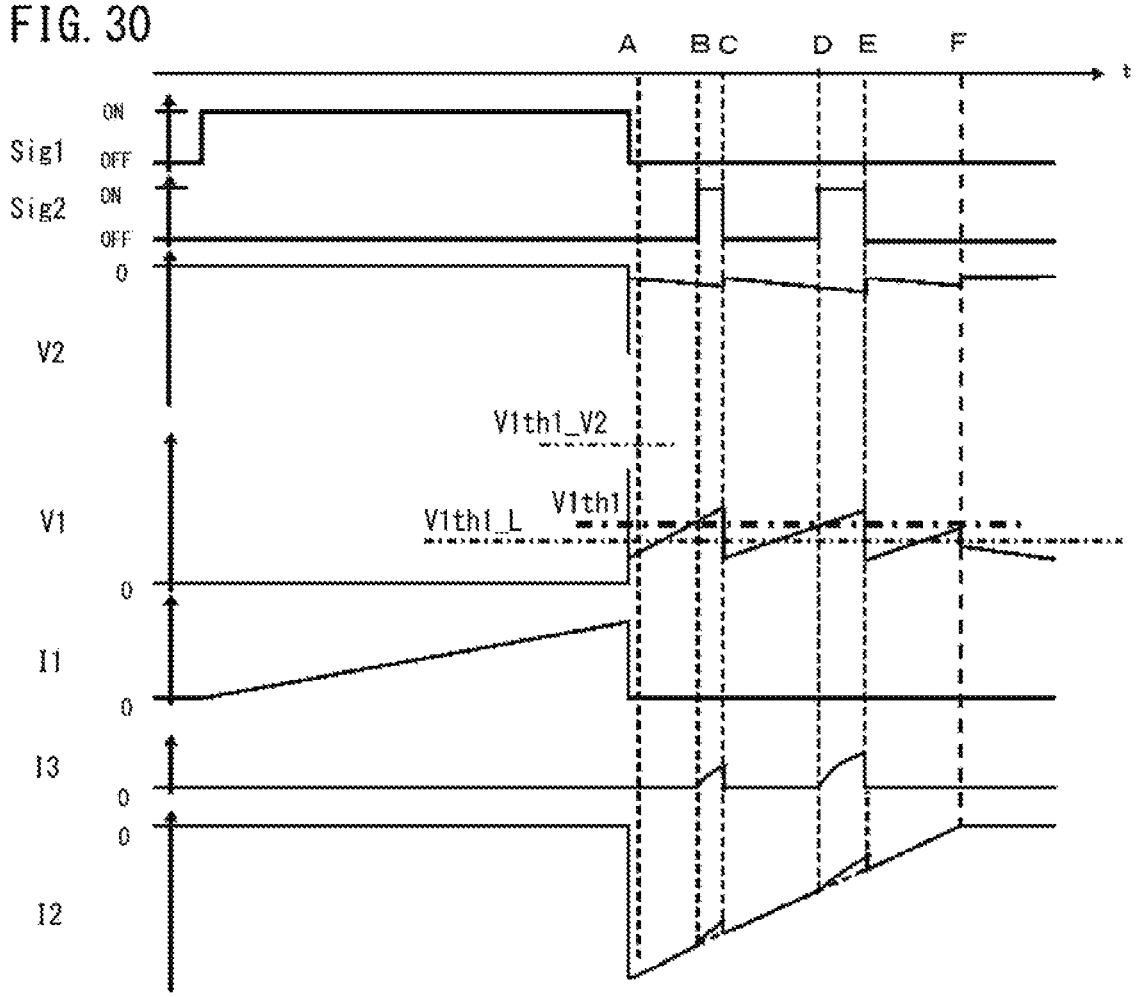
FIG. 30 is a chart representing a group of operation waveforms at a time when a peak value of the primary voltage in the ignition apparatus according to Embodiment 15 is smaller than the determination value.

An ignition apparatus according to Embodiment 15 will be explained. FIG. 29 is a chart representing a group of operation waveforms at a time when a peak value of the primary voltage V1 in an ignition apparatus 1 according to Embodiment 15 is larger than a high-primary-voltage peak determination value V1th1_V2. FIG. 30 is a chart representing a group of operation waveforms at a time when a peak value of the primary voltage V1 in the ignition apparatus 1 according to Embodiment 15 is smaller than the high-primary-voltage peak determination value V1th1_V2. The basic configuration and processing in the ignition apparatus 1 according to Embodiment 15 are the same as those according to Embodiment 12 represented in FIG. 22; however, only the function of the primary coil voltage detection circuit 81 is different. In Embodiment 15, the primary coil voltage detection circuit 81 compares a peak value of the primary voltage with the high-primary-voltage peak determination value V1th1_V2 and then selects, in accordance with the magnitude relationship, a reference value to be compared with the primary voltage V1 from the high-primary-voltage on/off threshold value V1th1 and a high-primary-voltage on/off low threshold value V1th1_L.

In the case where the filling efficiency Ce of an internal combustion engine is low, the pressure in a cylinder is low (a low load), or the distance of the gap of the ignition plug 21 is small, the value (absolute value) of the dielectric breakdown voltage of the ignition plug 21 becomes small; however, the resistance component in the discharging path also becomes small. Therefore, the discharge maintaining voltage after the dielectric breakdown also becomes small. In this case, the ignitability is low; thus, it is desirable that in order to secure the ignitability, suppression of the secondary current flowing in the secondary coil 20 by energization of the tertiary coil 30 is limited.

In contrast, in the case where the filling efficiency Ce is high, the pressure in the cylinder is high (a high load), or the distance of the gap of the ignition plug 21 is large, the value of the dielectric breakdown voltage becomes large; however, the resistance component in the discharging path also becomes large. Therefore, the discharge maintaining voltage after the dielectric breakdown also becomes large. In this case, the ignitability is high; therefore, consumption of the ignition plug 21 can be suppressed from increasing, by actively decreasing the secondary current flowing in the secondary coil 20 through energization of the tertiary coil 30.

The primary coil voltage detection circuit 81 and the second switching circuit control block 5 in the controller 3 are collectively referred to as the tertiary coil control unit 6; the tertiary coil control unit 6 changes a reference value to be compared with the primary voltage V1 in the high-primary-voltage-ON control, in accordance with the peak value of a voltage (the primary voltage V1) that is generated across the primary coil 10 immediately after energization of the primary coil 10 is cut off. Because the primary voltage V1 changes in proportion to the positive/negative inversion value of the secondary voltage V2, the peak value of the primary voltage V1 corresponds to the positive/negative inversion value of the secondary voltage V2 with the dielectric breakdown.

In this configuration, the reference value to be compared with the primary voltage V1 is changed in accordance with the peak value of the primary voltage V1 that correlates to the filling efficiency Ce of an internal combustion engine or the distance of the gap of the ignition plug 21, so that the energization period for the tertiary coil 30 can appropriately be increased or decreased.

In the present embodiment, in the case where the high-primary-voltage-ON control is performed, the larger the peak value of the primary voltage V1 at a time immediately after energization of the primary coil 10 has been cut off is, the more the tertiary coil control unit 6 lowers the reference value to be compared with the primary voltage V1.

In this configuration, it can be determined that the larger the peak value of the primary voltage V1 is, the larger the value of the dielectric breakdown voltage of the secondary voltage V2 is and the higher the ignitability is; therefore, it is made possible that the reference value to be compared with the primary voltage V1 is lowered and the energization period for the tertiary coil 30 is prolonged; thus, consumption of the ignition plug 21 can be suppressed from increasing. In contrast, it can be determined that the smaller the peak value of the primary voltage V1 is, the smaller the value of the dielectric breakdown voltage of the secondary voltage V2 is and the lower the ignitability is; therefore, it is made possible that the reference value to be compared with the primary voltage V1 is raised and the energization period for the tertiary coil 30 is shortened; thus, the ignitability can be raised.

For example, in the case where when the high-primary-voltage-ON control is performed, the peak value of the primary voltage V1 at a time immediately after energization of the primary coil 10 has been cut off is larger than the high-primary-voltage peak determination value V1th1_V2, the tertiary coil control unit 6 sets the reference value to be compared with the primary voltage V1 to the high-primary-voltage on/off low threshold value V1th1_L; in the case where the peak value of the primary voltage V1 is smaller than the high-primary-voltage peak determination value V1th1_V2, the tertiary coil control unit 6 sets the reference value to be compared with the primary voltage V1 to the high-primary-voltage on/off threshold value V1th1, which is a value larger than the high-primary-voltage on/off low threshold value V1th1_L.

The control behavior will be explained by use of the timing charts represented in FIGS. 29 and 30. FIG. 29 is a chart representing the case where when the high-primary-voltage-ON control is performed, the peak value of the primary voltage V1 is larger than the high-primary-voltage peak determination value V1th1_V2; FIG. 30 is a chart representing the case where the peak value of the primary voltage V1 is smaller than the high-primary-voltage peak determination value V1th1_V2.

When energization of the primary coil 10 is cut off by switching the driving signal Sig1 for the first switching circuit 11 in FIG. 29 from ON to OFF, the secondary voltage V2 increases in the minus direction up to the dielectric breakdown voltage and a spark discharge is produced due to a dielectric breakdown. When the spark discharge starts, the secondary voltage V2 decreases in the minus direction from the dielectric breakdown voltage and becomes a discharge maintaining voltage. The example in FIG. 29 illustrates a state where because the filling efficiency Ce is high and the pressure in the cylinder is high, both the respective absolute values of the dielectric breakdown voltage and the discharge maintaining voltage are large.

Accordingly, the peak value of the primary voltage V1, which corresponds to the positive/negative inversion value of the dielectric breakdown voltage, is larger than the high-primary-voltage peak determination value V1th1_V2; after that, the reference value to be compared with the primary voltage V1 is set to the high-primary-voltage on/off low threshold value V1th1_L, which is smaller than the high-primary-voltage on/off threshold value V1th1. As a result, the primary voltage V1 is higher than the high-primary-voltage on/off low threshold value V1th1_L, and hence the period in which the driving signal Sig2 to the second switching circuit 31 is ON is prolonged; then, the primary voltage V1 becomes lower than the high-primary-voltage on/off low threshold value V1th1_L, and hence the period in which the driving signal Sig2 to the second switching circuit 31 is OFF is shortened. Accordingly, in the case where it can be determined that the ignitability is high, consumption of the ignition plug 21 can be suppressed from increasing, by prolonging the energization period for the tertiary coil 30. The high-primary-voltage-ON control is performed in a spark discharging period from the time point A to the time point F.

When energization of the primary coil 10 is cut off by switching the driving signal Sig1 for the first switching circuit 11 in FIG. 30 from ON to OFF, the secondary voltage V2 increases in the minus direction up to the dielectric breakdown voltage and a spark discharge is produced due to a dielectric breakdown. When the spark discharge starts, the secondary voltage V2 decreases in the minus direction from the dielectric breakdown voltage and becomes a discharge maintaining voltage. The example in FIG. 30 illustrates a state where because the filling efficiency Ce low and hence the pressure in the cylinder is low, both the respective absolute values of the dielectric breakdown voltage and the discharge maintaining voltage are small.

Accordingly, the peak value of the primary voltage V1, which corresponds to the positive/negative inversion value of the dielectric breakdown voltage, is smaller than the high-primary-voltage peak determination value V1th1_V2, and the reference value to be compared with the primary voltage V1 is set to the high-primary-voltage on/off threshold value V1th1, which is larger than the high-primary-voltage on/off low threshold value V1th1_L. As a result, the primary voltage V1 is higher than the high-primary-voltage on/off threshold value V1th1, and hence the period in which the driving signal Sig2 to the second switching circuit 31 is ON is shortened; then, the primary voltage V1 becomes lower than the high-primary-voltage on/off threshold value V1th1, and hence the period in which the driving signal Sig2 to the second switching circuit 31 is OFF is prolonged. Accordingly, in the case where it can be determined that the ignitability is low, the ignitability can be raised, by shortening the energization period for the tertiary coil 30.

In this configuration, it can be determined that the larger the peak value of the primary voltage V1 is, the larger the value of the dielectric breakdown voltage is and the higher the ignitability is; therefore, it is made possible that the reference value to be compared with the primary voltage V1 is lowered and the energization period for the tertiary coil 30 is prolonged; thus, consumption of the ignition plug 21 can be suppressed from increasing. In contrast, it can be determined that the smaller the peak value of the primary voltage V1 is, the smaller the value of the dielectric breakdown voltage of the secondary voltage V2 is and the lower the ignitability is; therefore, it is made possible that the reference value to be compared with the primary voltage V1 is decreased and the energization period for the tertiary coil 30 is shortened; thus, the ignitability can be raised.

In the present embodiment, there has been explained an example in which for the peak value of the primary voltage V1, the reference value to be compared with the primary voltage V1 is switched between the two steps; however, the reference value may be switched among three steps or more. Moreover, the reference value to be compared with the primary voltage V1 may be set steplessly (continuously) in accordance with a peak value of the primary voltage V1.

16. Embodiment 16

<Low-Primary-Voltage-ON Control Corresponding to Peak Value of Primary Voltage>

An ignition apparatus according to Embodiment 16 will be explained. The basic configuration and processing in the ignition apparatus 1 according to Embodiment 16 are the same as those according to Embodiment 12 represented in FIG. 22; however, only the function of the primary coil voltage detection circuit 81 in the controller 3 is different. A figure of operation waveforms related to Embodiment 16 will be omitted.

In Embodiment 16, the primary coil voltage detection circuit 81 compares the peak value of the primary voltage at a time when a spark discharge starts with a low-primary-voltage peak determination value V1th2_V2; in accordance with the magnitude relationship, the primary coil voltage detection circuit 81 sets the reference value to be compared with the following primary voltage V1 to the low-primary-voltage cutoff threshold value V1th2, when the peak value is large, and to a low-primary-voltage cutoff low threshold value V1th2_L, when the peak value is small. Then, by comparing the primary voltage V1 with the selected reference value, the primary coil voltage detection circuit 81 performs low-primary-voltage-ON control in such a way as to make the second switching circuit control block 5 in the controller 3 output an ON signal, when the primary voltage V1 is small, and in such a way as to make the second switching circuit control block 5 output an OFF signal, when the primary voltage V1 is large.

In the case where the filling efficiency Ce of an internal combustion engine is low, the pressure in a cylinder is low (a low load), or the distance of the gap of the ignition plug 21 is small, the value (absolute value) of the dielectric breakdown voltage of the ignition plug 21 becomes small; however, the resistance component in the discharging path also becomes small. Therefore, the discharge maintaining voltage after the dielectric breakdown also becomes small. In this case, the ignitability is low; thus, it is desirable that in order to secure the ignitability, suppression of the secondary current flowing in the secondary coil 20 by energization of the tertiary coil 30 is limited. In this situation, in the case of a high rotation speed region where the rotation speed of the internal combustion engine is high, the in-cylinder flow becomes large and hence a spark discharge becomes liable to be blown off. In that case, i.e., in the case where a discharging path is long (that is to say, the primary voltage corresponding to the discharge maintaining voltage is high), energization of the tertiary coil 30 is stopped and the level of the secondary current I2 is kept high, so that it is made possible that the spark discharge becomes less likely to be blown off and hence the ignitability is maintained.

Accordingly, in the case where the peak value of the primary voltage V1 of the ignition apparatus 1 is low, the low-primary-voltage cutoff threshold value V1th2, which is a threshold value for stopping energization of the tertiary coil 30, is changed to the low-primary-voltage cutoff low threshold value V1th2_L, which is a value smaller than the low-primary-voltage cutoff threshold value V1th2, so that the region where the energization of the tertiary coil 30 is stopped is expanded; as a result, it is made possible that a spark discharge becomes less likely to be blown off and that consumption of the ignition plug is suppressed by energizing the tertiary coil 30 in a region where the primary voltage V1 is lower than the low-primary-voltage cutoff low threshold value V1th2_L.

In contrast, in the case where the filling efficiency Ce is high, the pressure in the cylinder is high (a high load), or the distance of the gap of the ignition plug 21 is large, the value of the dielectric breakdown voltage becomes large; however, the resistance component in the discharging path also becomes large. Therefore, the discharge maintaining voltage after the dielectric breakdown also becomes large. In this case, the ignitability is high; therefore, consumption of the ignition plug 21 can be suppressed from increasing, by actively decreasing the secondary current flowing in the secondary coil 20 through energization of the tertiary coil 30.

Accordingly, in the case where the peak value of the primary voltage V1 of the ignition apparatus 1 is high, the threshold value for stopping energization of the tertiary coil 30 is set not to the low-primary-voltage cutoff low threshold value V1th2_L, which is a small value, but to the low-primary-voltage cutoff threshold value V1th2, so that the region where the energization of the tertiary coil 30 is performed is expanded; as a result, it is made possible that the ignitability is kept and consumption of the ignition plug is suppressed, by energizing the tertiary coil 30 in a region where the primary voltage V1 is lower than the low-primary-voltage cutoff threshold value V1th2.

In Embodiment 16, there has been explained an example in which for the peak value of the primary voltage V1, the reference value to be compared with the primary voltage V1 is switched between the two steps; however, the reference value may be switched among three steps or more. Moreover, the reference value to be compared with the primary voltage V1 may be set steplessly (continuously) in accordance with a peak value of the primary voltage V1. A figure of operation waveforms related to Embodiment 16 is omitted. The low-primary-voltage peak determination value V1th2_V2 and the low-primary-voltage cutoff low threshold value V1th2_L according to Embodiment 16 are unillustrated parameters. It may be allowed that the control according to Embodiment 16 and the control according to Embodiment 15 are performed in a combined manner. Because they are performed in a combined manner, maintaining the ignitability and suppressing the consumption of the ignition plug 21 can be implemented in a wide range; thus, it is significant.

17. Embodiment 17

<Hysteresis of Threshold Value>

An ignition apparatus 1 according to Embodiment 17 will be explained. In the ignition apparatus according to Embodiment 17, in the case where the primary voltage V1 is detected and then is compared with a predetermined threshold value, a hysteresis is provided.

Figure 31:
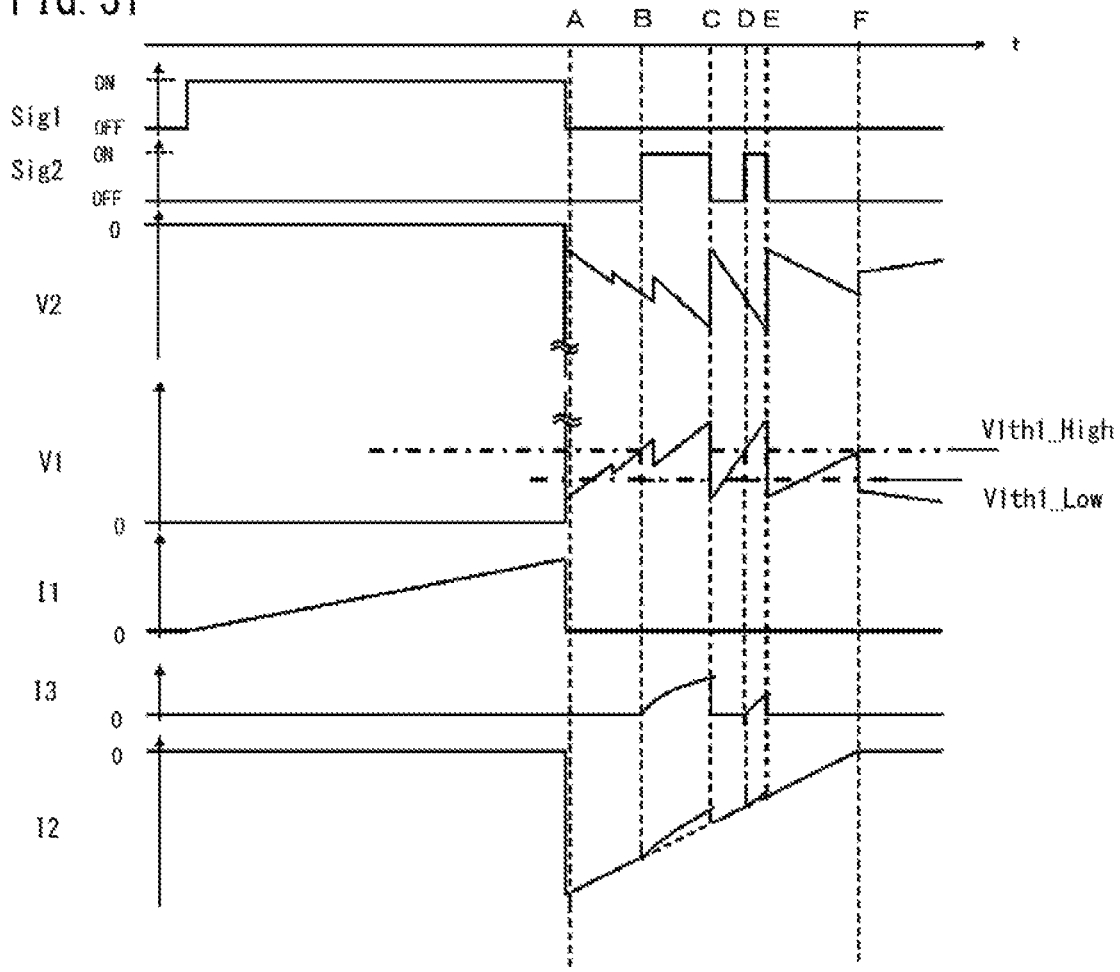
FIG. 31 is a chart representing a group of operation waveforms in an ignition apparatus according to Embodiment 17.

An example in which Embodiment 17 is applied to the high-primary-voltage-ON control will be explained below. The hardware configuration is the same as that in FIG. 22, which is a circuit diagram of foregoing Embodiment 12; the different point is that a hysteresis is provided in the comparison between a predetermined threshold value and the primary voltage V1 in the primary coil voltage detection circuit 81. FIG. 31 is a chart representing a group of operation waveforms in the ignition apparatus 1 according to Embodiment 17.

The ignition apparatus according to Embodiment 17 has a lower side setting value (V1th1_Low) of a preliminarily set threshold value at a time when the controller 3 thereof compares the threshold value with the value of the primary voltage V1, detected by the primary coil voltage detection circuit 81 after the secondary current I2 has been generated, and then determines that the foregoing value of the primary voltage V1 is lower than the threshold value and an upper side setting value (V1th1_High) of the foregoing threshold value at a time when the controller 3 determines that the value of the primary voltage V1 is higher than the foregoing threshold value; The upper side setting value (V1th1_High) is set to a value larger than the lower side setting value (V1th1_Low).

This configuration makes it possible that by performing a determination with a hysteresis, a minute change in the primary voltage V1 is prevented from making the second switching circuit 31 turn on or off at high speed; thus, turning on or off of the second switching circuit 31 can be stabilized.

FIG. 31 is a chart representing a group of operation waveforms in the ignition apparatus 1 according to Embodiment 17. The control behavior at a time when the high-primary-voltage-ON control is performed will be explained by use of a timing chart represented in FIG. 31. When energization of the primary coil 10 is cut off by switching the driving signal Sig1 for the first switching circuit 11 from ON to OFF, the secondary voltage V2 falls down to the dielectric breakdown voltage and a spark discharge is produced due to a dielectric breakdown. When the spark discharge starts, the secondary voltage V2 increases from the dielectric breakdown voltage and becomes a discharge maintaining voltage.

At the time point A when a spark discharge starts, the tertiary coil 30 is OFF and it is determined whether or not the second switching circuit 31 is to be turned on; thus, the determination reference value is set to the high-primary-voltage on/off upper side threshold value V1th1_High, which has been set to a value larger than the high-primary-voltage on/off lower side threshold value V1th1_Low. When immediately after the time point B, the primary voltage V1 becomes larger than the high-primary-voltage on/off upper side threshold value V1th1_High, the tertiary coil control unit 6 turns on the second switching circuit 31.

After the second switching circuit 31 is turned on, it is determined whether or not the second switching circuit 31 is to be turned off; thus, the determination reference value is changed to the high-primary-voltage on/off lower side threshold value V1th1_Low, which has been set to a value smaller than the high-primary-voltage on/off upper side threshold value V1th1_High. When at the time point C, the primary voltage V1 becomes lower than the high-primary-voltage on/off lower side threshold value V1th1_Low, the tertiary coil control unit 6 turns off the second switching circuit 31.

After the second switching circuit 31 is turned off, it is determined whether or not the second switching circuit 31 is to be turned on; thus, the determination reference value is changed to the high-primary-voltage on/off upper side threshold value V1th1_High, which has been set to a value larger than the high-primary-voltage on/off lower side threshold value V1th1_Low. When at the time point D, the primary voltage V1 becomes higher than the high-primary-voltage on/off upper side threshold value V1th1_High, the tertiary coil control unit 6 turns on the second switching circuit 31.

After the second switching circuit 31 is turned on, the determination reference value is changed to the high-primary-voltage on/off lower side threshold value V1th1_Low. When at the time point E, the primary voltage V1 becomes lower than the high-primary-voltage on/off lower side threshold value V1th1_Low, the tertiary coil control unit 6 turns off the second switching circuit 31. After that, because magnetic energy that has been stored in the iron core is used up at the time point F, the spark discharge ends. The high-primary-voltage-ON control is performed in a spark discharging period from the time point A to the time point F.

In the spark discharging period from the time point A to the time point F, the primary voltage V1 minutely changes, due to shortening of the discharging path or the like; however, the determination with a hysteresis makes it possible that the second switching circuit 31 is prevented from turning on or off at high speed; thus, turning on or off of the second switching circuit 31 can be stabilized.

In the foregoing description, there has been explained the case where a hysteresis is added when in the high-primary-voltage-ON control in Embodiment 12, comparison between the value of the primary voltage V1 and a predetermined threshold value is performed. The setting of a hysteresis for the threshold value can be applied also to the low-primary-voltage-ON control in Embodiment 13.

In that case, the low-primary-voltage-ON control in Embodiment 13, which is performed by use of the low-primary-voltage cutoff threshold value V1th2, can be replaced by low-primary-voltage-ON control in which a hysteresis is set by use of a low-primary-voltage cutoff lower side threshold value V1th2 Low and a low-primary-voltage cutoff upper side threshold value V1th2 High, which has a value higher than the low-primary-voltage cutoff lower side threshold value V1th2 Low. In the case where it is determined whether or not the primary voltage V1 is higher than a threshold value, the low-primary-voltage cutoff upper side threshold value V1th2 High is utilized. In the case where it is determined whether or not the primary voltage V1 is lower than a threshold value, the low-primary-voltage cutoff lower side threshold value V1th2 Low is utilized. The low-primary-voltage cutoff lower side threshold value V1th2 Low and the low-primary-voltage cutoff upper side threshold value V1th2 High are unillustrated parameters.

This configuration makes it possible that even when due to shortening of the discharging path or the like, the primary voltage V1 minutely changes during a spark discharge, the second switching circuit 31 is prevented from turning on or off at high speed, by performing a determination with a hysteresis; thus, turning on or off of the second switching circuit 31 can be stabilized.

It is clear that in each of Embodiments 12 through 16, the same effect can be obtained by providing a hysteresis in the threshold value to be compared with the primary voltage.

In each of foregoing Embodiments 1 through 17, the first switching circuit 11 and the second switching circuit 31 are represented by respective circuits incorporated in the ignition apparatus 1; however, they may be incorporated in the controller 3.

Moreover, with regard to the driving signal Sig2 that is outputted from the controller 3 and turns on or off the second switching circuit 31, it may be allowed that driving signals Sig2 for two or more cylinders are transmitted through a common signal wire so as to control the respective second switching circuits 31.

Although the present application is described above in terms of various exemplary embodiments and implementations, it should be understood that the various features, aspects and functions described in one or more of the individual embodiments are not limited in their applicability to the particular embodiment with which they are described, but instead can be applied, alone or in various combinations to one or more of the embodiments. It is therefore understood that numerous modifications which have not been exemplified can be devised without departing from the scope of the technology disclosed in the specification of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF REFERENCE NUMERALS

1: ignition apparatus
3: controller
11: first switching circuit
12: ignition-coil power source
20: secondary coil
21: ignition plug
30: tertiary coil
31: second switching circuit
40: ignition coil

What is claimed is:

1. An ignition apparatus comprising:
an ignition coil including
a primary coil,
a secondary coil that is magnetically coupled with the primary coil and supplies a secondary current to an ignition plug, and
a tertiary coil that is magnetically coupled with the primary coil and the secondary coil and generates energization flux for reducing the secondary current;
a first switching circuit for performing on/off-switching of energization of the primary coil from a power source;
a second switching circuit for performing on/off-switching of energization of the tertiary coil; and
a controller that performs on/off-control of the first switching circuit so as to generate the secondary current in the secondary coil through a change in flux generated in the primary coil, thereby causing a spark discharge in the ignition plug and that performs on/off-switching of the second switching circuit after the secondary current has been generated, thereby reducing the secondary current through a change in flux in the tertiary coil.

2. The ignition apparatus according to claim 1, wherein the tertiary coil and the second switching circuit are connected in series with each other in a looped electric wire.

3. The ignition apparatus according to claim 1, wherein the tertiary coil and the second switching circuit are connected in series with each other in an electric wire whose both ends are connected with the ground.

4. The ignition apparatus according to claim 1, wherein the tertiary coil and the second switching circuit are connected in series with each other in an electric wire whose one end is connected with the power source and whose other end is connected with the ground.

5. The ignition apparatus according to claim 4, wherein the controller decreases and then increases the secondary current by performing off-after-on control in which after the secondary current has been generated, the second switching circuit is turned on and then turned off.

6. The ignition apparatus according to claim 1, wherein the controller performs two or more times off-after-on control in which after the secondary current has been generated, the second switching circuit is turned on and then turned off.

7. The ignition apparatus according to claim 1, wherein the second switching circuit is provided with a voltage protection circuit for limiting the voltage across the second switching circuit to a preliminarily set limit voltage or lower, and wherein due to the dielectric breakdown voltage of the ignition plug at a time when the spark discharge is caused, the limit voltage is set to be higher than the voltage generated across the second switching circuit through the intermediary of the tertiary coil.

8. The ignition apparatus according to claim 1, wherein the turn ratio of the number of turns of the tertiary coil to the number of turns of the secondary coil is set in such a way that in a period in which the secondary current is generated, the voltage to be generated across the tertiary coil becomes the same as or larger than the on-time saturation voltage of the second switching circuit.

9. The ignition apparatus according to claim 1, wherein a current limiting circuit for suppressing a current flowing in the tertiary coil is provided.

10. The ignition apparatus according to claim 1, wherein a current detection circuit for detecting the secondary current is provided, and wherein in the case where after the secondary current has been generated, the value of the secondary current detected by the current detection circuit becomes smaller than a preliminarily set on/off threshold value, the controller turns off the second switching circuit, and in the case where the value of the secondary current becomes larger than the on/off threshold value, the controller turns on the second switching circuit.

11. The ignition apparatus according to claim 1, wherein a current detection circuit for detecting the secondary current is provided, and wherein in the case where after the secondary current has been generated, the value of the secondary current detected by the current detection circuit becomes smaller than a preliminarily set cutoff threshold value, the controller turns on the second switching circuit.

12. The ignition apparatus according to claim 10, wherein the ignition coil incorporates the current detection circuit and part, of the controller, that performs on/off-switching of the second switching circuit, based on the secondary current detected by the current detection circuit.

13. The ignition apparatus according to claim 1, wherein after determining, based on a driving state of a vehicle, at least one of an energization starting timing, an energization period, a post-energization energization cutoff period, and an on/off repetition period for the tertiary current and after the secondary current has been generated, the controller performs on/off-switching of the second switching circuit, based on the energization starting timing, the energization period, the post-energization energization cutoff period, and the on/off repetition period.

14. The ignition apparatus according to claim 1, wherein a primary coil voltage detection circuit for detecting a primary coil voltage to be generated across the primary coil is provided, and wherein the controller performs high-primary-voltage-ON control in which in the case where after the secondary current has been generated, the value of the primary coil voltage detected by the primary coil voltage detection circuit becomes smaller than a preliminarily set high-primary-voltage-ON threshold value, the second switching circuit is turned off and in the case where the value of the primary coil voltage becomes larger than the high-primary-voltage-ON threshold value, the second switching circuit is turned on.

15. The ignition apparatus according to claim 1, wherein a primary coil voltage detection circuit for detecting a primary coil voltage to be generated across the primary coil is provided, and wherein the controller performs low-primary-voltage-ON control in which in the case where after the secondary current has been generated, the value of the primary coil voltage detected by the primary coil voltage detection circuit becomes smaller than a preliminarily set low-primary-voltage-ON threshold value, the second switching circuit is turned on and in the case where the value of the primary coil voltage becomes larger than the low-primary-voltage-ON threshold value, the second switching circuit is turned off.

16. The ignition apparatus according to claim 1, further comprising an operation state detection means that detects an operation state of an internal combustion engine provided with the ignition apparatus and a primary coil voltage detection circuit for detecting a primary coil voltage to be generated across the primary coil, wherein the controller performs at least one of high-primary-voltage-ON control in which in the case where when the operation state is in a first operation region, the secondary current is generated and then the value of the primary coil voltage detected by the primary coil voltage detection circuit becomes smaller than a preliminarily set high-primary-voltage-ON threshold value, the second switching circuit is turned off and in the case where the value of the primary coil voltage becomes larger than the high-primary-voltage-ON threshold value, the second switching circuit is turned on, and low-primary-voltage-ON control in which in the case where when the operation state is in a second operation region, the secondary current is generated and then the value of the primary coil voltage becomes smaller than a preliminarily set low-primary-voltage-ON threshold value, the second switching circuit is turned on and in the case where the value of the primary coil voltage becomes larger than the low-primary-voltage-ON threshold value, the second switching circuit is turned off.

17. The ignition apparatus according to claim 14, wherein the controller changes the threshold value in accordance with a peak value of the primary coil voltage at a time after the secondary current has been generated.

18. The ignition apparatus according to claim 14, wherein the controller decreases the high-primary-voltage-ON threshold value, as a peak value of the primary coil voltage at a time after the secondary current has been generated increases.

19. The ignition apparatus according to claim 15, wherein the controller increases the low-primary-voltage-ON threshold value, as a peak value of the primary coil voltage at a time after the secondary current has been generated increases.

20. The ignition apparatus according to claim 14, wherein the controller is provided with a lower side setting value of the threshold value at a time when after the secondary current is generated, the value of the primary coil voltage detected by the primary coil voltage detection circuit is compared with the preliminarily set threshold value and then it is determined that the value of the primary coil voltage is lower than the preliminarily set threshold value, and an upper side setting value of the threshold value at a time when it is determined that the value of the primary coil voltage is higher than the preliminarily set threshold value, and wherein the upper side setting value is set to a value larger than the lower side setting value.

* * * * *